US012108843B2

(12) United States Patent
Chen

(10) Patent No.: US 12,108,843 B2
(45) Date of Patent: Oct. 8, 2024

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 15 days.

(21) Appl. No.: 18/052,573

(22) Filed: Nov. 4, 2022

(65) Prior Publication Data

US 2023/0092419 A1 Mar. 23, 2023

Related U.S. Application Data

(63) Continuation-in-part of application No. 17/662,076, filed on May 5, 2022, now Pat. No. 11,849,810.

(30) Foreign Application Priority Data

Aug. 18, 2021 (TW) ..... 110209782
Aug. 11, 2022 (CN) ..... 202210961142.9

(51) Int. Cl.
*A43C 11/22* (2006.01)

(52) U.S. Cl.
CPC ..... *A43C 11/22* (2013.01)

(58) Field of Classification Search
CPC ..... A43C 11/22; A43C 11/165
See application file for complete search history.

(56) References Cited

U.S. PATENT DOCUMENTS 4,633,599 A * 1/1987 Morell ..... A43C 11/16 242/389
5,606,778 A * 3/1997 Jungkind ..... A43C 11/165 24/68 SK
2005/0247813 A1* 11/2005 Kovacevich ..... A42B 3/14 242/395
2007/0084956 A1* 4/2007 Chen ..... A43C 7/00 242/388.6
2009/0211385 A1* 8/2009 Fiquepron ..... A42B 3/145 74/422
2010/0139057 A1* 6/2010 Soderberg ..... A43C 11/16 242/396.2
2010/0251524 A1* 10/2010 Chen ..... A43C 11/165 24/713.2
2011/0191992 A1* 8/2011 Chen ..... A43C 11/008 24/713.2
2016/0198801 A1 7/2016 Kim et al.
2016/0213099 A1* 7/2016 Ha ..... A43C 11/20
2016/0262496 A1* 9/2016 Midorikawa ..... A43C 11/165
2017/0027287 A1* 2/2017 Burns ..... A43B 13/14
2017/0042289 A1* 2/2017 Ha ..... A44B 99/00
2017/0202315 A1* 7/2017 Chen ..... A43C 1/00
2017/0224056 A1* 8/2017 Midorikawa ..... A43C 11/165
2017/0295888 A1* 10/2017 Chen ..... A43C 11/165
(Continued)

FOREIGN PATENT DOCUMENTS

WO 2016114568 A1 7/2016
WO 2016114569 A1 7/2016

*Primary Examiner* — David M Upchurch
(74) *Attorney, Agent, or Firm* — CKC & Partners Co., LLC

(57) ABSTRACT

A fastening device includes a case unit including a receiving space, a spool located within the receiving space and configured for a lace to be wound therearound, and a knob covering on the case unit. The knob includes a main body made of a composite material, and a shield cover covering on the main body and made of a metal material. A rotation of the knob drives the spool to rotate in a tightening direction for tensioning the lace.

9 Claims, 30 Drawing Sheets

(56) References Cited

U.S. PATENT DOCUMENTS

| | | | | |
|---|---|---|---|---|
| 2017/0303643 | A1* | 10/2017 | Converse | A61F 5/0118 |
| 2017/0325548 | A1* | 11/2017 | Ha | A43C 11/165 |
| 2019/0174872 | A1* | 6/2019 | Kawano | A43B 5/04 |
| 2020/0205523 | A1* | 7/2020 | Kawano | A44B 11/12 |
| 2020/0268108 | A1* | 8/2020 | Fiedler | A45C 13/1069 |
| 2021/0037926 | A1* | 2/2021 | Kim | A43C 7/08 |
| 2021/0227937 | A1* | 7/2021 | Hu | A43C 7/08 |
| 2021/0401121 | A1* | 12/2021 | Kim | A41F 1/008 |

* cited by examiner

FASTENING DEVICE

RELATED APPLICATIONS

This application is a Continuation-in-part of U.S. application Ser. No. 17/662,076, filed on May 5, 2022, which claims priority to Taiwan Application Serial Number 110209782, filed on Aug. 18, 2021, and also claims priority to China application No. 202210961142.9, filed on Aug. 11, 2022, which are herein incorporated by reference.

BACKGROUND

Technical Field

The present disclosure relates to a fastening device. More particularly, the present disclosure relates to a fastening device for securing an article through loosening or tensioning a lace.

Description of Related Art

In daily life, cords, such as a lace or a thread, are usually used to tighten articles. The most common tightening method is to use the cord to reciprocately pass through holes on the article, e.g., eyelets of a shoe, and then tie a knot to secure the article. But in this kind of tightening method, the knot is loosened easily owing to an external force. Not only does the knot need to be tied again, but also lots of inconveniences come owing to the insecurity of the articles.

In order to solve such problems, some practitioners developed a simple fastening mechanism including a case, an engaging unit and a spring. The case includes holes configured for the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space for receiving the lace, and the exposure of the lace may bring danger.

Therefore, some practitioners developed another kind of buckle which can be rotated to tension the lace, and the lace can be received inside the buckle. Through the interference between components inside the buckle, the length of the lace as well as the tightness can be adjusted. However, the structure of the buckle generally includes a case and a knob made of a metal material, which is heavy and has a high cost.

Based on the above-mentioned problems, how to solve the problems becomes a pursued target for practitioners.

SUMMARY

According to one aspect of the present disclosure, a fastening device includes a case unit including a receiving space, a spool located within the receiving space and configured for a lace to be wound therearound, and a knob covering on the case unit. The knob includes a main body made of a composite material, and a shield cover covering on the main body and made of a metal material. A rotation of the knob drives the spool to rotate in a tightening direction for tensioning the lace.

BRIEF DESCRIPTION OF THE DRAWINGS

The disclosure can be more fully understood by reading the following detailed description of the embodiments, with reference made to the accompanying drawings as follows.

DETAILED DESCRIPTION

It will be understood that when an element (or mechanism or module) is referred to as being "disposed on", "connected to" or "coupled to" another element, it can be directly disposed on, connected or coupled to the other element, or intervening elements may also be present. In contrast, when an element is referred to as being "directly disposed on", "directly connected to" or "directly coupled to" another element, there are no intervening elements present.

In addition, the terms first, second, third, etc. are used herein to describe various elements or components, these elements or components should not be limited by these terms. Consequently, a first element or component discussed below could be termed a second element or component.

Figure 1:
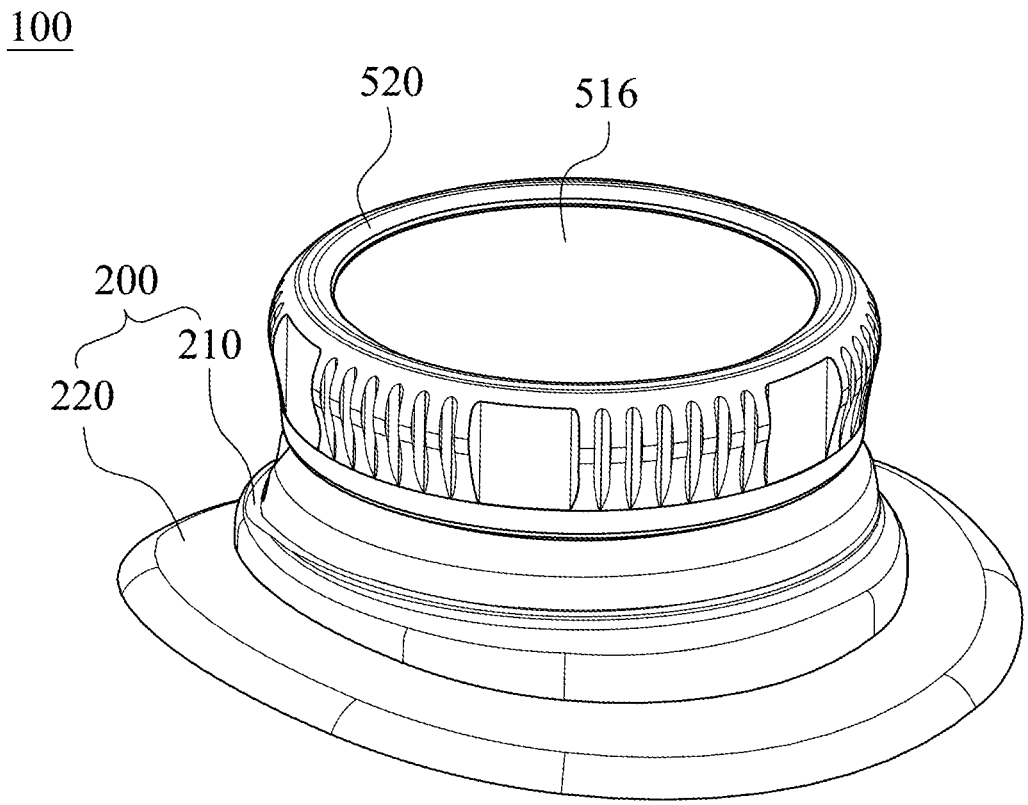
FIG. 1 shows a three dimensional schematic view of a fastening device according to a first embodiment of the present disclosure.
Figure 2:
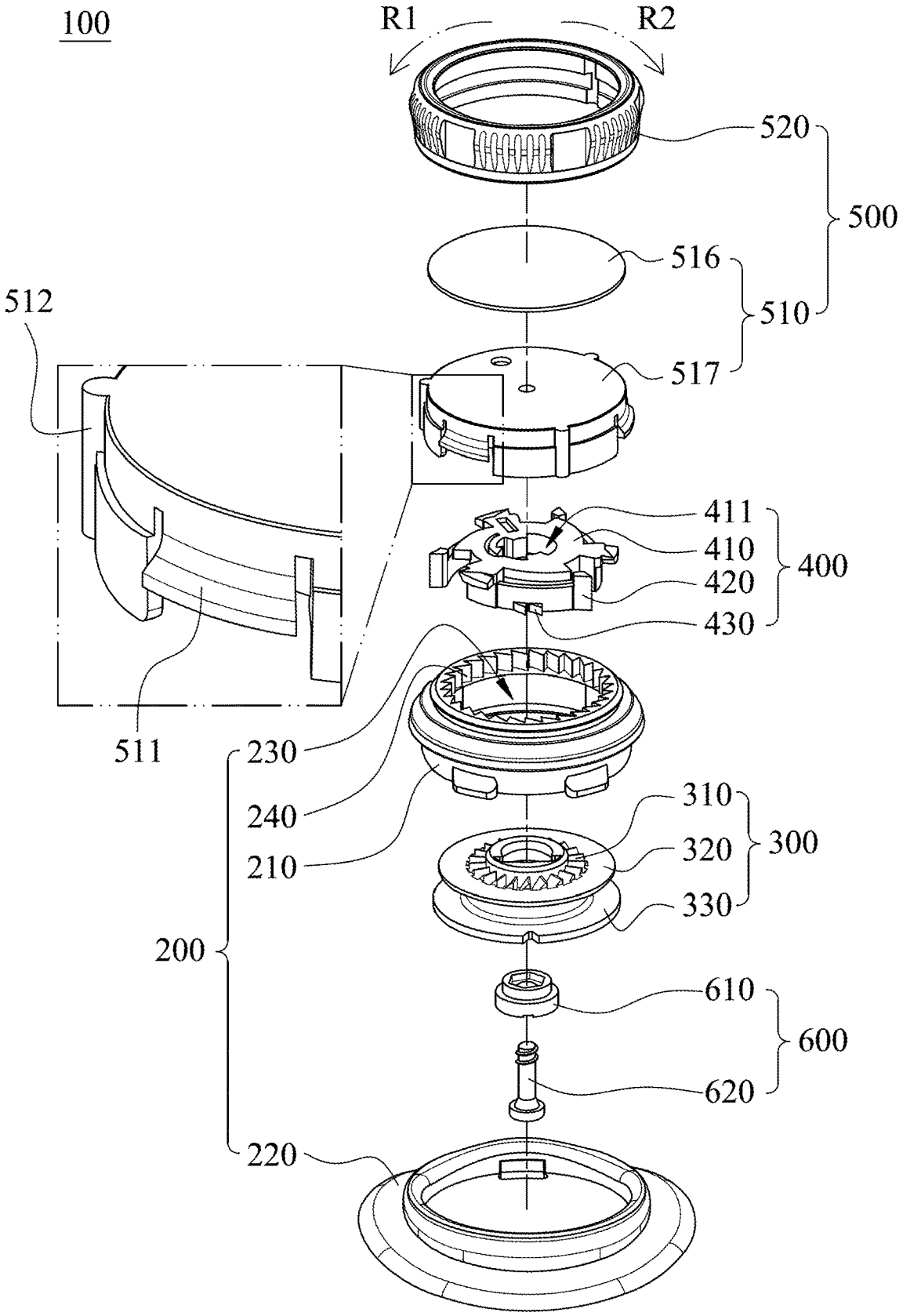
FIG. 2 shows one exploded view of the fastening device of FIG. 1.
Figure 3:
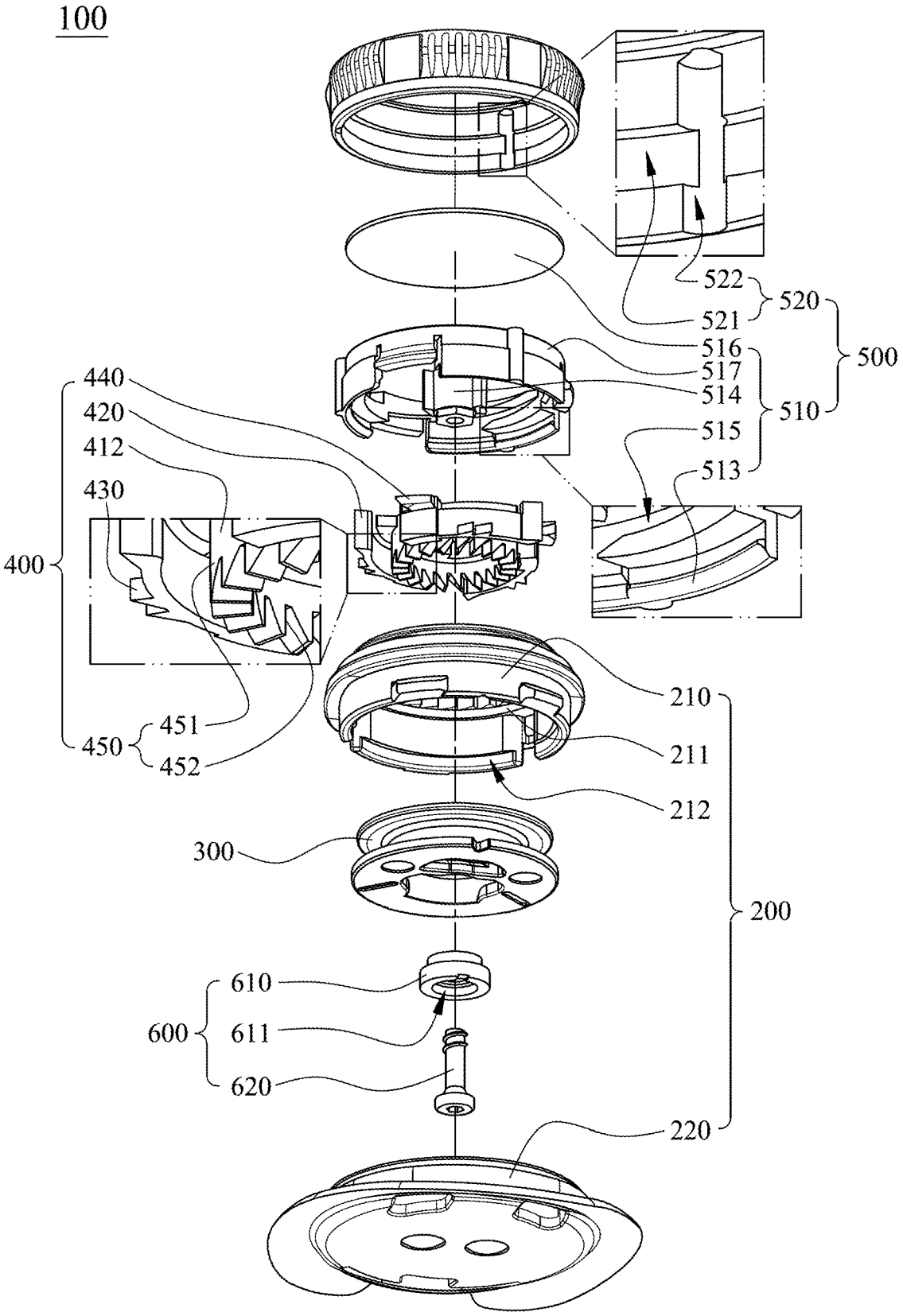
FIG. 3 shows another exploded view of the fastening device of FIG. 1.

FIG. 1 shows a three dimensional schematic view of a fastening device 100 according to a first embodiment of the present disclosure. FIG. 2 shows one exploded view of the fastening device 100 of FIG. 1. FIG. 3 shows another exploded view of the fastening device 100 of FIG. 1. As shown in FIG. 1 to FIG. 3, the fastening device 100 includes a case unit 200 including a receiving space 230, a spool 300 located within the receiving space 230 and configured for a lace (not shown) to be wound therearound, and a knob 500 covering on the case unit 200. The knob 500 includes a main body 510 and an outer annular portion 520 surrounding the main body 510. The main body 510 includes a top portion 516, and the top portion 516 is made of a composite material. The outer annular portion 520 is made of a metal material. A rotation of the knob 500 drives the spool 300 to rotate in a tightening direction R2 for tensioning the lace.

Therefore, through the configuration that the knob 500 includes the outer annular portion 520 and the main body 510, and the outer annular portion 520 is made of a metal material while the main body 510 is made of other materials, the weight as well as the cost can be reduced while the structural strength is remained. The details of the fastening device 100 will be described hereinafter.

The case unit 200 of the fastening device 100 can include an annular wall 210, a base 220 and a plurality of mounting teeth 240. The annular wall 210 defines the receiving space 230 and includes an upper opening (not labeled) and a lower opening (not labeled). The base 220 is detachably connected to the annular wall 210 to close the lower opening. The mounting teeth 240 are located at the annular wall 210 and face toward the receiving space 230. Moreover, each of the mounting teeth 240 can include a tip portion. The spool 300 can include an upper ring portion 320. A distance between two tip portions of two opposite mounting teeth 240 is smaller than a diameter of the upper ring portion 320, thereby preventing the spool 300 from leaving the receiving space 230 from an upper opening of the annular wall 210.

To be more specific, except for the upper ring portion 320, the spool 300 can further include a lower ring portion 330 and a plurality of second combining teeth 310. A winding track formed between the upper ring portion 320 and the lower ring portion 330 is configured for the lace to wind therearound. The second combining teeth 310 are located above the upper ring portion 320. Through the relation of the diameters, the mounting teeth 240 can restrict the upper ring portion 320 to prohibit the spool 300 from moving upward. A portion of the annular wall 210 adjacent to the mounting teeth 240 can protrude radially and inward to form an upper protruding flange 211. The distance between two root portions of two opposite mounting teeth 240 is smaller than or equal to an inner diameter of the upper protruding flange 211. In the first embodiment, the upper protruding flange 211 extends to the upper opening, the mounting teeth 240 are located at the upper protruding flange 211, and the distance between two root portions of two opposite mounting teeth 240 is equal to the inner diameter of the upper protruding flange 211. In addition, a height in an axial direction I1 (shown in FIG. 4) is larger than a height of each of the mounting teeth 240, and a part of the upper protruding flange 211 is not covered by the mounting teeth 240 such that the upper ring portion 320 can also be restricted by the upper protruding flange 211, but the present disclosure is not limited thereto.

As shown in FIGS. 2 and 3, the annular wall 210 can further include a lower ring groove 212, and the lower ring groove 212 is located at a lower end of the annular wall 210. With the lower ring portion 330 of the spool 300 being received in the lower ring groove 212, preventing the spool 300 from leaving the receiving space 230 from the upper opening of the annular wall 210 can also be achieved. In other words, during manufacturing the annular wall 210, the inner diameter thereof can be verified to form the upper protruding flange 211 adjacent to the mounting teeth 240, the lower ring groove 212 near the base 220 and the middle section in the middle, and the diameters arranged in sequence, from large to small, are the lower ring groove 212, the middle section and the upper protruding flange 211. The distance between two tip portions of the two opposite mounting teeth 240 is smaller than the diameter of the upper protruding flange 211.

The case unit 200 can further include a snapping portion 250 (shown in FIG. 4), the main body 510 can further include a coupling portion 513, and the snapping portion 250 is coupled to the coupling portion 513 to connect the main body 510 to the case unit 200. The snapping portion 250 is located at an upper end of the annular wall 210 and has a groove structure. The coupling portion 513 is located at a lower end of the inner surface of the main body 510, and has a protrusion structure. Consequently, the snapping portion 250 can be coupled to the coupling portion 513 via a snap-fit engagement, and the main body 510 can cover on the annular wall 210 to close the upper opening.

The material of the outer annular portion 520 can be, for example, aluminum, copper, zinc or the alloy thereof, which can have an advantage of light weight. The composite material of the top portion 516 can be, for example, a carbon-fiber composite material, which can have advantages of light weight and high strength. In addition, the main body 510 can further include a cover portion 517 located between the case unit 200 and the top portion 516, and the cover portion 517 is made of plastic. In the first embodiment, although the cover portion 517 is illustrated as being separated from the top portion 516, in other embodiments, the cover portion and the top portion can be formed integrally using the dual-injecting process to allow the main body to be a one-piece element having different materials. The materials of the top portion and the cover portion are not limited to the above, and other non-metal materials or other composite materials can be used. The outer annular portion can also be made of other metal materials, and the present disclosure is not limited thereto.

The outer annular portion 520 can include an upper restricting portion 523 (shown in FIG. 4) protruding inward from an upper edge of the outer annular portion 520 and being ring-shaped, and the top portion 516 is abutted between the upper restricting portion 523 and the cover portion 517. A thickness of the top portion 516 is uniform, and a distance H1 (shown in FIG. 4) between an upper surface of the top portion 516 and the upper edge of the outer annular portion 520 is larger than zero. In other words, as the top portion 516 and the cover portion 517 are assembled inside the outer annular portion 520, the top portion 516 is lower than the upper edge of the outer annular portion 520.

Moreover, the main body 510 can further include at least one radial engaging portion 511, the knob 500 can further include at least one radial coupling portion 521 located at the outer annular portion 520, and the at least one radial engaging portion 511 is coupled to the at least one radial coupling portion 521. In addition, the main body 510 can further include at least one axial rib 512, the knob 500 can further include at least one axial slot 522 located at the outer annular portion 520, and the at least one axial rib 512 is received in the at least one axial slot 522.

To be more specific, a number of the radial engaging portions 511 and a number of the axial ribs 512 are both three. Each of the three radial engaging portions 511 is staggered from each of the three axial ribs 512 and is arranged on the outer surface of the cover portion 517. A number of the axial slots 522 is three and the axial slots 522 are located at an inner surface of the outer annular portion 520. The inner surface of the outer annular portion 520 can be depressed to form an inner annular groove, and the three axial slots 522 are communicated with the inner annular groove and split the inner annular groove into three segments to form the three radial coupling portions 521 for cooperating with the three radial engaging portions 511.

Hence, the three radial engaging portions 511 are associated with the three radial coupling portions 521 to assemble the main body 510 and the outer annular portion 520. The cooperation between the axial rib 512 and the axial slot 522 can prevent rotation between the outer annular portion 520 and the cover portion 517, and can be favorable for transferring the operating force of the user. Furthermore, the outer annular portion 520 can include a plurality of anti-slip strips (not labeled) to increase the friction between the outer annular portion 520 and the user.

The fastening device 100 can further include an engaging unit 400 located above the spool 300. An operation of the knob 500, for example rotating the knob 500 in a loosening direction R1, allows the engaging unit 400 to be lifted along the axial direction I1 and to switch from a first position to a second position, and when the engaging unit 400 is in the first position, a rotation of the knob 500 drives the spool 300 to rotate in the tightening direction R2 for tensioning the lace. As the engaging unit 400 is located in the second position, the spool 300 is allowed to release the lace.

Precisely, the engaging unit 400 can include a ring body 410, three pawl arms 420, three stop portions 430 and three guiding portions 440. The ring body 410 includes a central hole 411 configured for the central post 514 of the main body 510 to insert thereinto. The three pawl arms 420 protrude from the ring body 410 and are spaced apart from each other. The three stop portions 430 are disposed at the three pawl arms 420, respectively. The three guiding portions 440 are configured for cooperated with the spiral track 515 of the main body 510.

The engaging unit 400 can further include a plurality of first combining teeth 450, and when the engaging unit 400 is located in the first position, the first combining teeth 450 are engaged with the second combining teeth 310. Each of the first combining teeth 450 is formed integrally with the ring body 410 and protrudes toward the spool 300. An outer tooth-facet 451 of each of the first combining teeth 450 is extended downward and integrally from an outer surface 412 of the ring body 410. In other words, the distance between two opposite outer tooth-facets 451 is equal to the outer diameter of the outer surface 412. Each of the first combining teeth 450 can further include a first longitudinal facet 452, and the first longitudinal facet 452 is substantially parallel to the axial direction I1. Each of the second combining teeth 310 can include a second longitudinal facet (not labeled) corresponding to the first longitudinal facet 452. When the engaging unit 400 is rotated in the tightening direction R2, the first longitudinal facet 452 pushes the second longitudinal facet of the spool 300, thereby favorable for transferring the rotary force of the engaging unit 400.

Furthermore, the fastening device 100 can further include a connecting unit 600 connected to the main body 510 of the knob 500 and being restricted by the spool 300. Precisely, the connecting unit 600 includes a stop plate 610 and a screw member 620. The stop plate 610 includes a through hole 611. The stop plate 610 inserts the central clearance hole (not labeled) of the spool 300, and the screw member 620 inserts upward into the through hole 611 of the stop plate 610 to fasten with the central post 514, thereby allowing the screw member 620 to be restricted by the stop plate 610 and allowing the stop plate 610 to be restricted by the spool 300.

Figure 4:
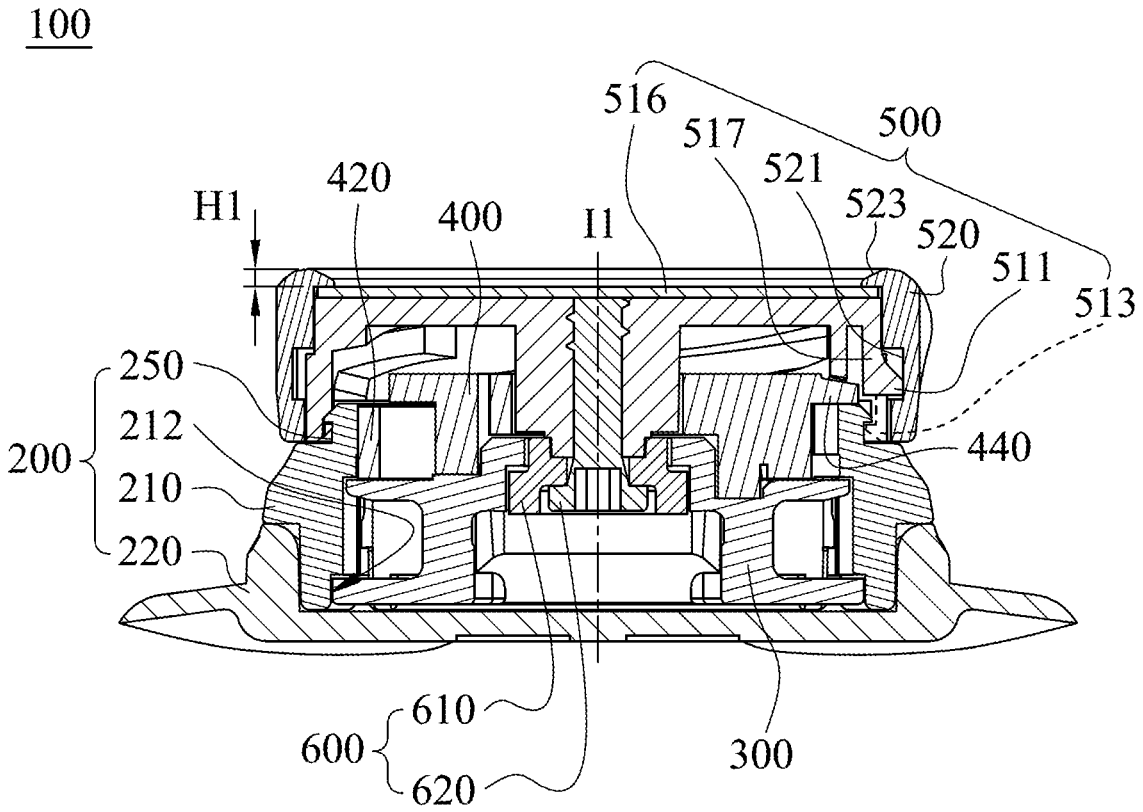
FIG. 4 shows one cross-sectional view of the fastening device of FIG. 1.
Figure 5:
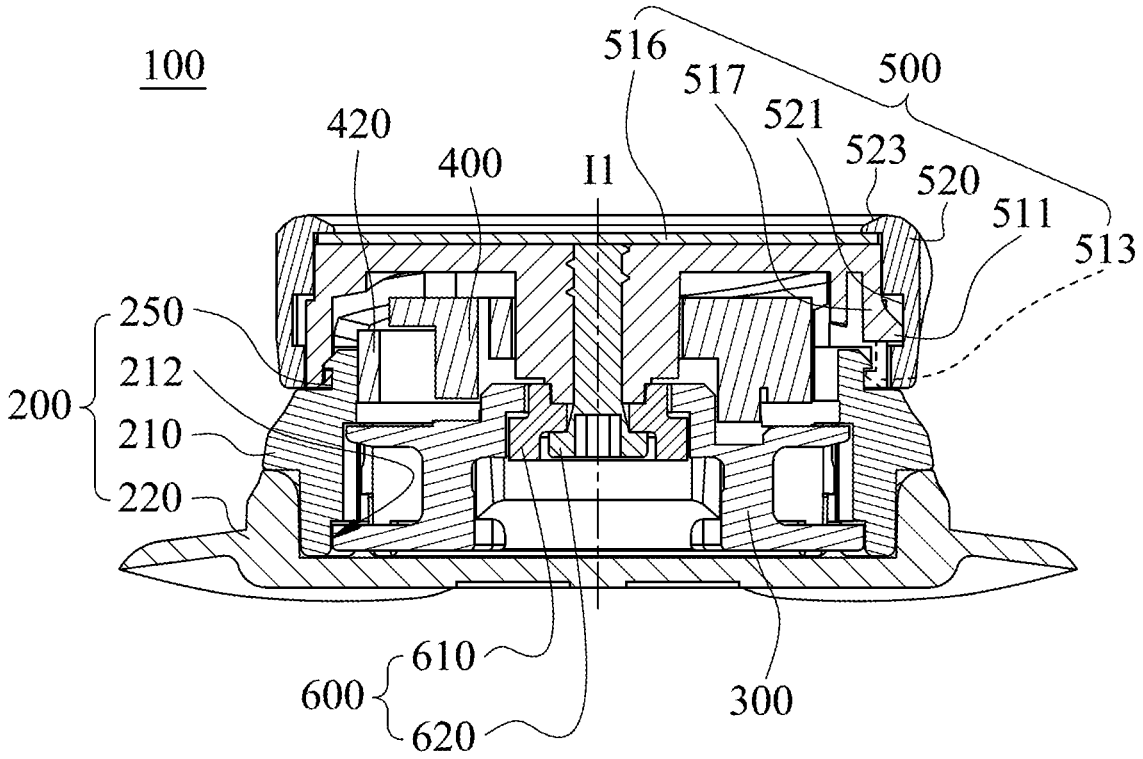
FIG. 5 shows another cross-sectional view of the fastening device of FIG. 1.

FIG. 4 shows one cross-sectional view of the fastening device 100 of FIG. 1. FIG. 5 shows another cross-sectional view of the fastening device 100 of FIG. 1. As shown in FIG. 4, the engaging unit 400 is located in the first position, the first combining teeth 450 of the engaging unit 400 are engaged with the second combining teeth 310 of the spool 300, and the pawl arms 420 are engaged correspondingly with the mounting teeth 240. As the user holds the outer annular portion 520 to rotate the knob 500 in the tightening direction R2, the engaging unit 400 is allowed to be rotated simultaneously, and a distal end of the pawl arm 420 can be disengaged from the mounting teeth 240, thereby allowing the spool 300 to rotate in the tightening direction R2 for tensioning the lace. As the user stops exerting the force, the distal end of the pawl arm 420 is engaged with the mounting teeth 240 to prevent the spool 300 from rotating in the loosening direction R1, and the lace cannot be unwound.

In contrast, as shown in FIG. 5, as the user is looking forward to release the lace, the user can hold the outer annular portion 520 to rotate the knob 500 in the loosening direction R1. Owing to the restriction that the distal end of the pawl arm 420 is engaged with the mounting teeth 240, the engaging unit 400 cannot rotate simultaneously, and the guiding portions 440 are guided by the spiral track 515 to allow the engaging unit 400 to be raised along the axial direction I1 and to be switched to the second position. Thus, the first combining teeth 450 of the engaging unit 400 are disengaged from the second combining teeth 310 of the spool 300, the spool 300 is not restricted, and pulling the lace can rotate the spool 300 in the loosening direction R1, thereby unwinding the lace. Moreover, the distal end of the pawl arm 420 can still be engaged with the mounting teeth 240, and since the first combining teeth 450 are disengaged from the second combining teeth 310 of the spool 300, the engaging unit 400 will not affect the spool 300. Furthermore, as the engaging unit 400 is in the second position, the stop portion 430 can be engaged with the mounting teeth 240, and as the user rotates the knob 500 in the tightening direction R2, the configuration is favorable for the engaging unit 400 to lower to the first position. Please be noted that, the stop portion 430 will not be engaged with the mounting teeth 240 when the engaging unit 400 is in the first position, and rotation of the spool 300 in the tightening direction R2 is not affected.

Figure 6:
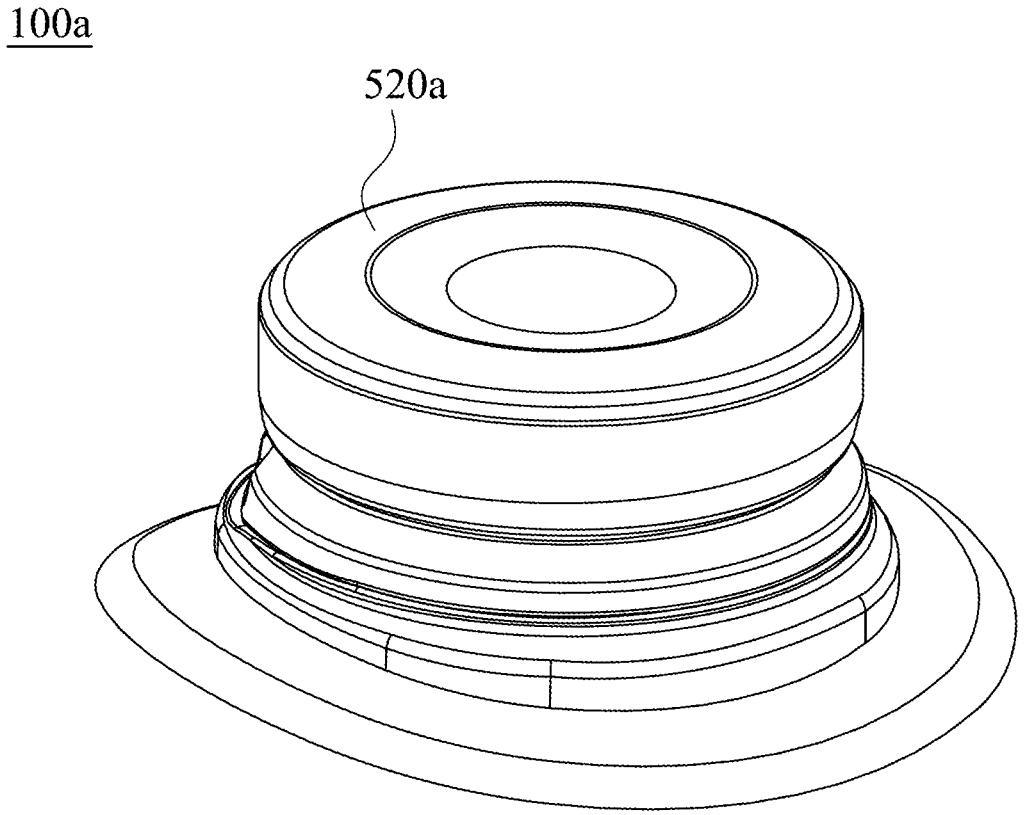
FIG. 6 shows a three dimensional schematic view of a fastening device according to a second embodiment of the present disclosure.
Figure 7:
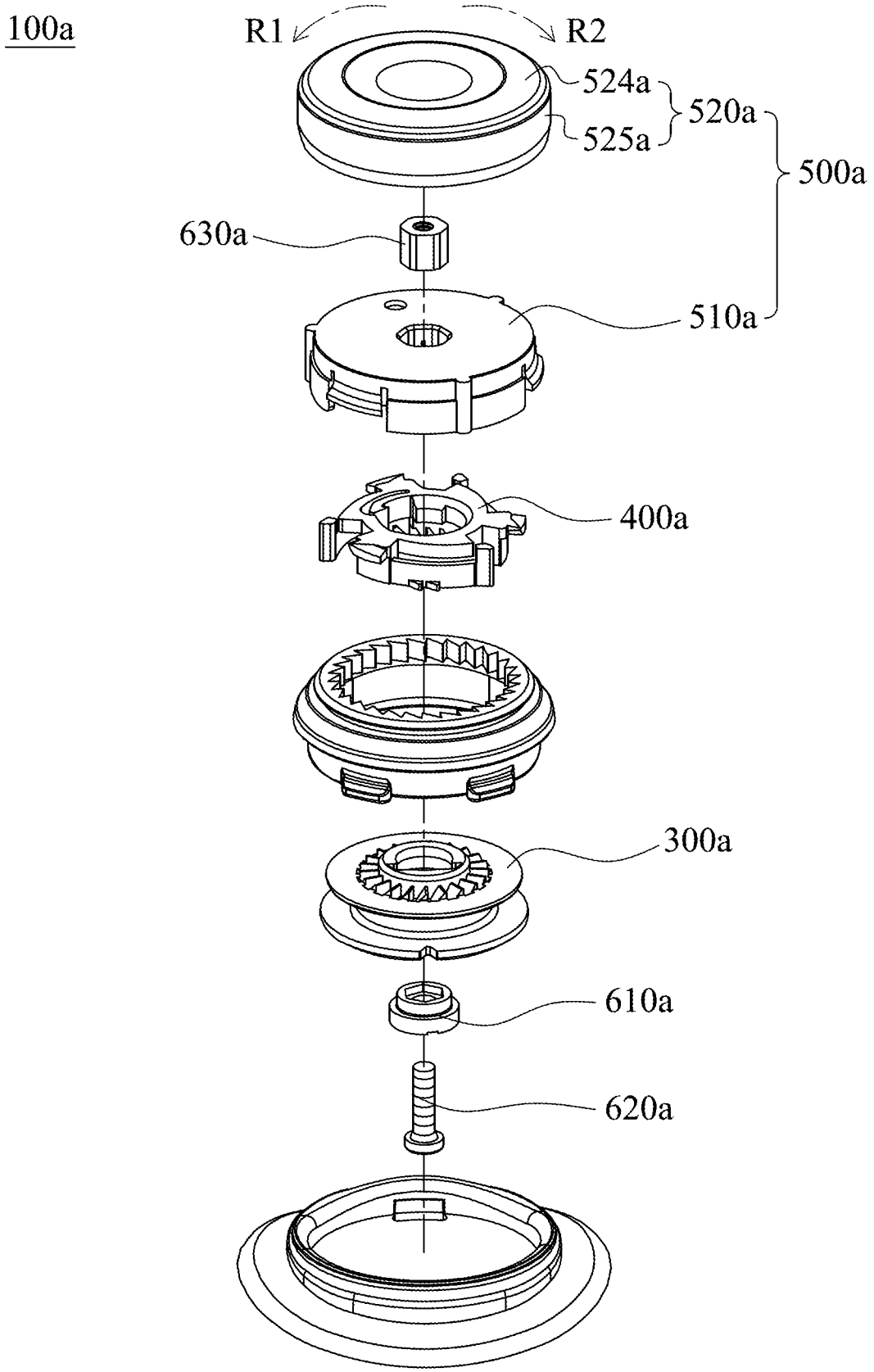
FIG. 7 shows one exploded view of the fastening device of FIG. 6.
Figure 8:
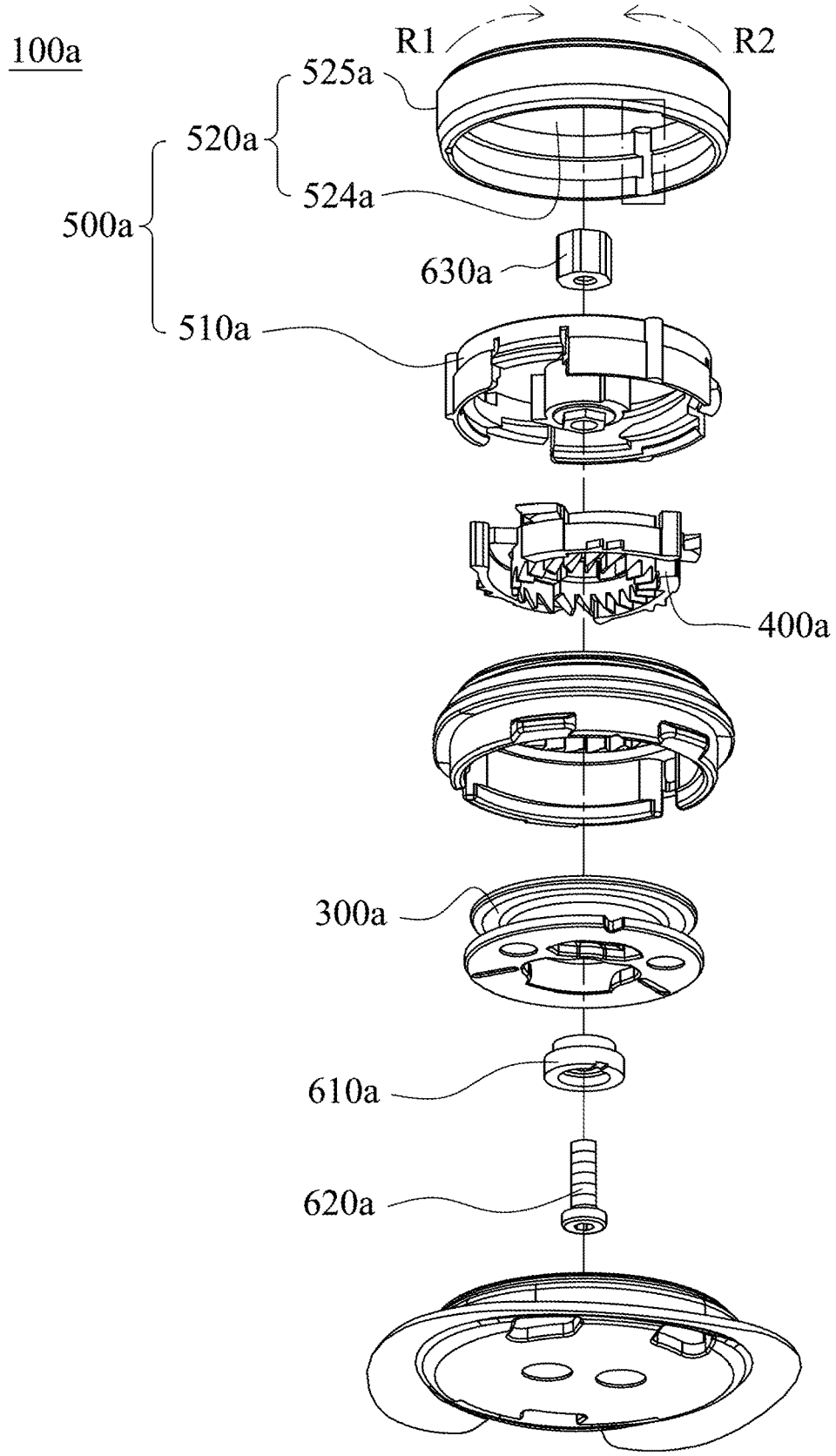
FIG. 8 shows another exploded view of the fastening device of FIG. 6.
Figure 9:
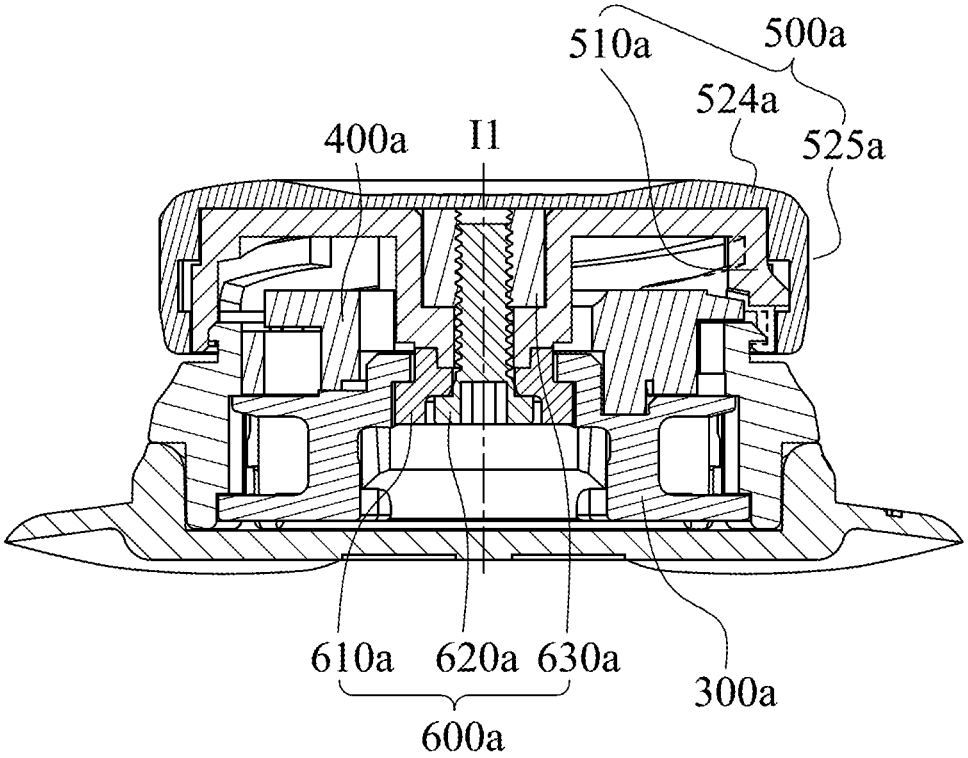
FIG. 9 shows one cross-sectional view of the fastening device of FIG. 6.
Figure 10:
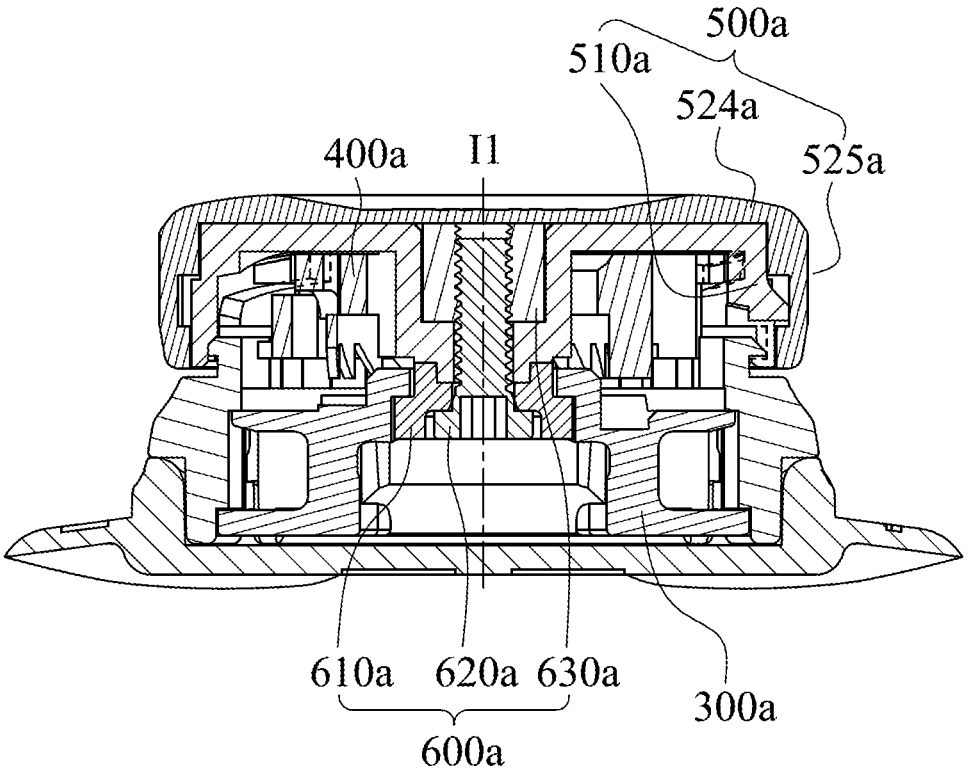
FIG. 10 shows another cross-sectional view of the fastening device of FIG. 6.

FIG. 6 shows a three dimensional schematic view of a fastening device 100*a* according to a second embodiment of the present disclosure. FIG. 7 shows one exploded view of the fastening device 100*a* of FIG. 6. FIG. 8 shows another exploded view of the fastening device 100*a* of FIG. 6. FIG. 9 shows one cross-sectional view of the fastening device 100*a* of FIG. 6. FIG. 10 shows another cross-sectional view of the fastening device 100*a* of FIG. 6. The fastening device 100*a* of the second embodiment is similar to the fastening device 100 of the first embodiment and includes a knob 500*a*, an engaging unit 400*a*, a spool 300*a*, a connecting unit 600*a*, and a case unit (not labeled in the second embodiment). The different structures will be further specified, and the details of similar structures will not be repeated.

The knob 500*a* can include a main body 510*a* and a shield cover 520*a*. The main body 510*a* is a one piece element made of plastic or doped plastic. The shield cover 520*a* covers on the main body 510*a* and is made of metal. The shield cover 520*a* includes an outer annular portion 525*a* and a metal top portion 524*a*. In other words, the metal top portion 524*a* is integrally connected to the outer annular portion 525*a* to form the shield cover 520*a* covering on the main body 510*a*, and a cross section of the shield cover 520*a* is therefore an "n" shape which totally convers the main body 510*a*. Please be noted that, the outer annular portion 525*a* of the second embodiment is similar to the outer annular portion 520 of the first embodiment, but the outer annular portion 525*a* is integrally formed with the metal top portion 524*a* while the outer annular portion 520 is not integrally formed with a top portion. Therefore, the main body 510*a* also includes at least one radial engaging portion, the shield cover 520*a* includes at least one radial coupling portion located at the outer annular portion 525*a*, and the at least one radial coupling portion is coupled to the at least one radial engaging portion.

The connecting unit 600*a* can include a stop plate 610*a*, a screw member 620*a* and a screw sleeve 630*a*. The screw sleeve 630*a* is disposed in the central post of the main body 510*a*, and the screw member 620*a* passes through the stop plate 610*a* to fasten into the screw sleeve 630*a*. Since the central post protrudes downward from the inner top surface of the main body 510*a*, and the screw sleeve 630*a* is located inside the central post, the shield cover 520*a* can be assembled after the main body 510*a*, the engaging unit 400*a* and the spool 300*a* are assembled. The assembly is convenient, and the aesthetic is increased owing to that the connecting unit 600*a* is not exposed.

Figure 11:
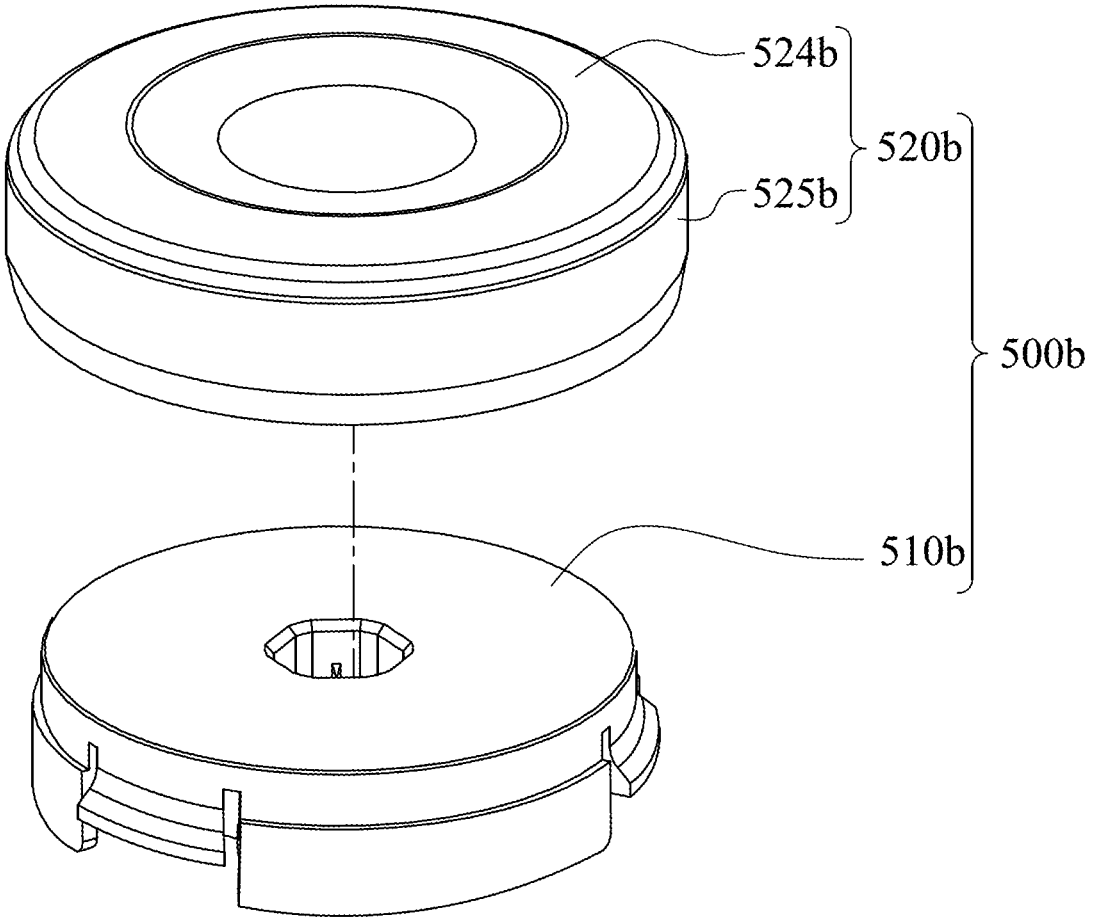
FIG. 11 shows one exploded view of a knob of a fastening device according to a third embodiment of the present disclosure.
Figure 12:
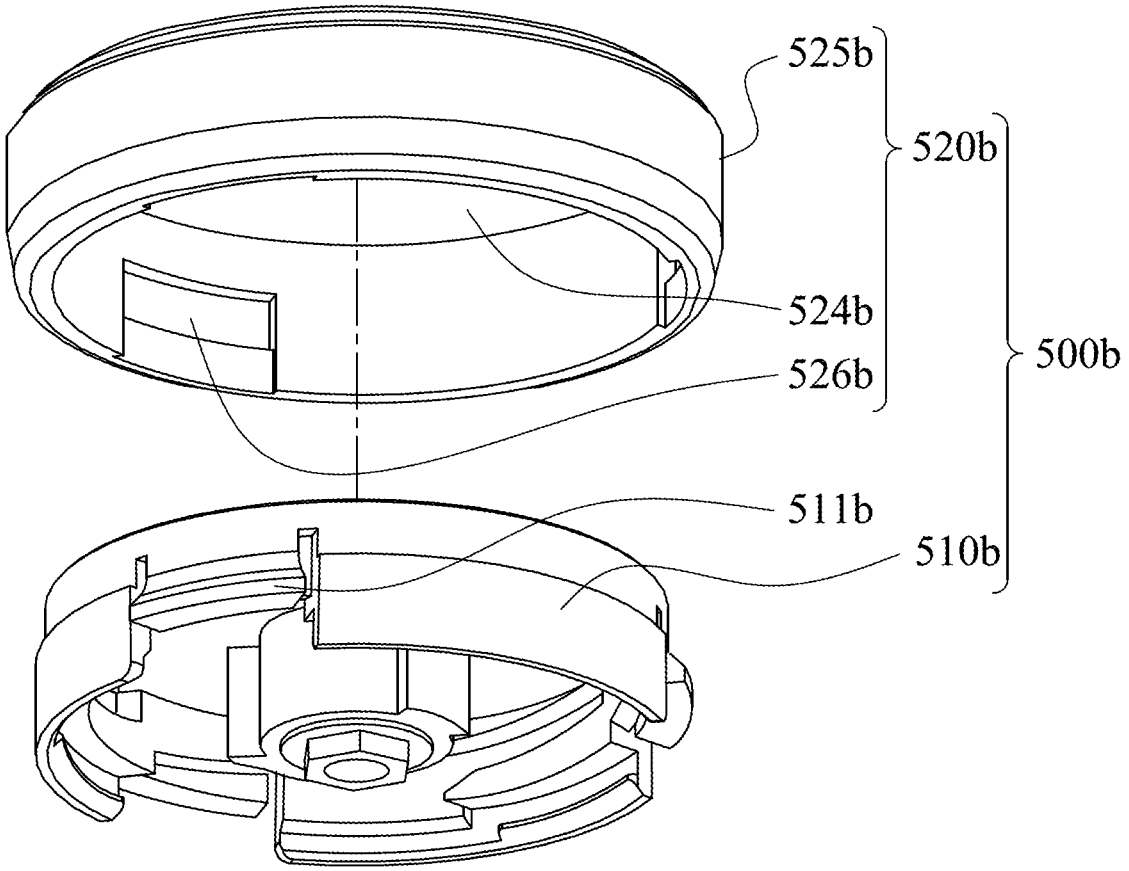
FIG. 12 shows another exploded view of the knob of the fastening device of FIG. 11.

FIG. 11 shows one exploded view of a knob 500*b* of a fastening device according to a third embodiment of the present disclosure. FIG. 12 shows another exploded view of the knob 500*b* of the fastening device of FIG. 11. In the third embodiment, the structures, except to the structure of the knob 500*a*, are similar to the second embodiment, and are thus not shown in the drawings. The knob 500*b* can include a main body 510*b* and a shield cover 520*b*. The shield cover 520*b* includes a metal top portion 524*b* and an outer annular portion 525*b*. The outer annular portion 525*b* includes a radial coupling portion 526*b*. The main body 510*b* can include a radial engaging portion 511*b*. The radial coupling portion 526*b* is different from the second embodiment and includes four restricting surfaces arranged in four sides thereof, and the radial coupling portion 526*b* is configured to receive the radial engaging portion 511*b*. Hence, as the shield cover 520*b* are assembled with the main body 510*b*, the four restricting surfaces of the radial coupling portion 526*b* can restrict the radial engaging portion 511*b* in the radial and axial direction, thereby preventing separation of the main body 510*b* and the shield cover 520*b*.

Figure 13:
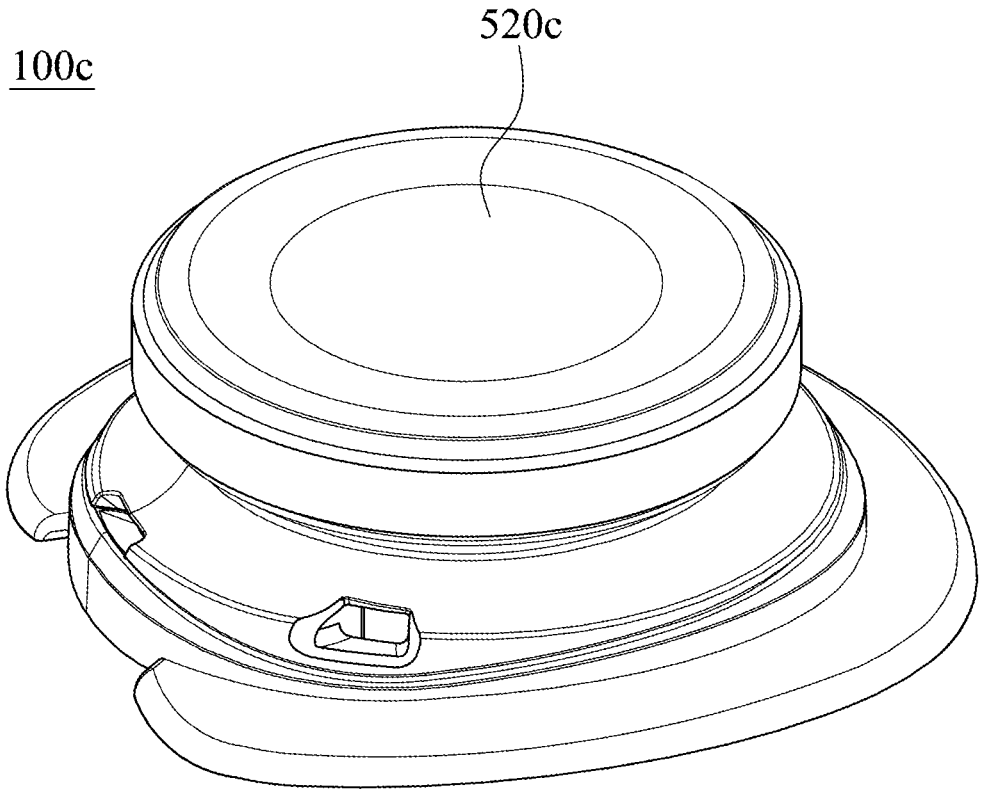
FIG. 13 shows a three dimensional schematic view of a fastening device according to a fourth embodiment of the present disclosure.
Figure 14:
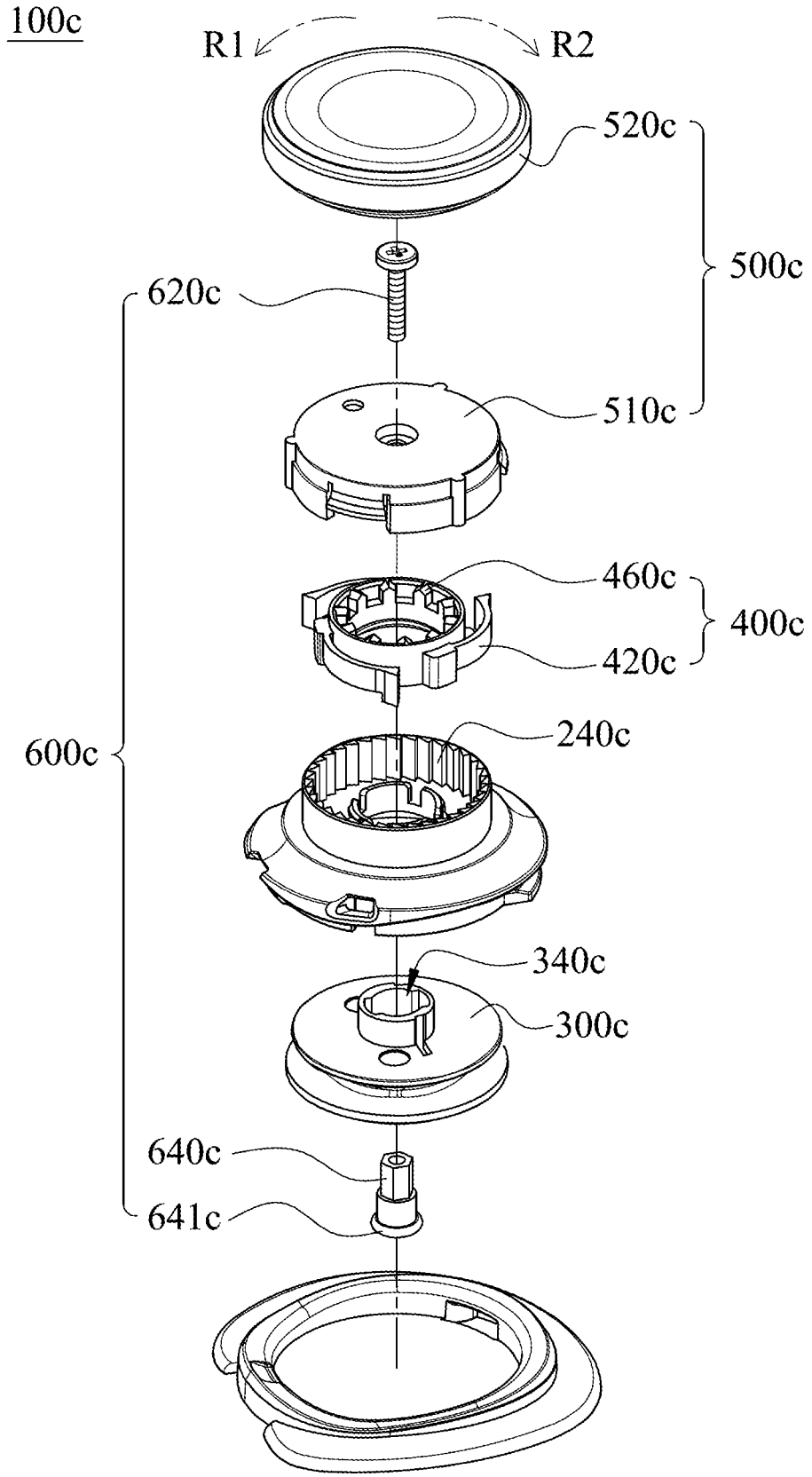
FIG. 14 shows one exploded view of the fastening device of FIG. 13.
Figure 15:
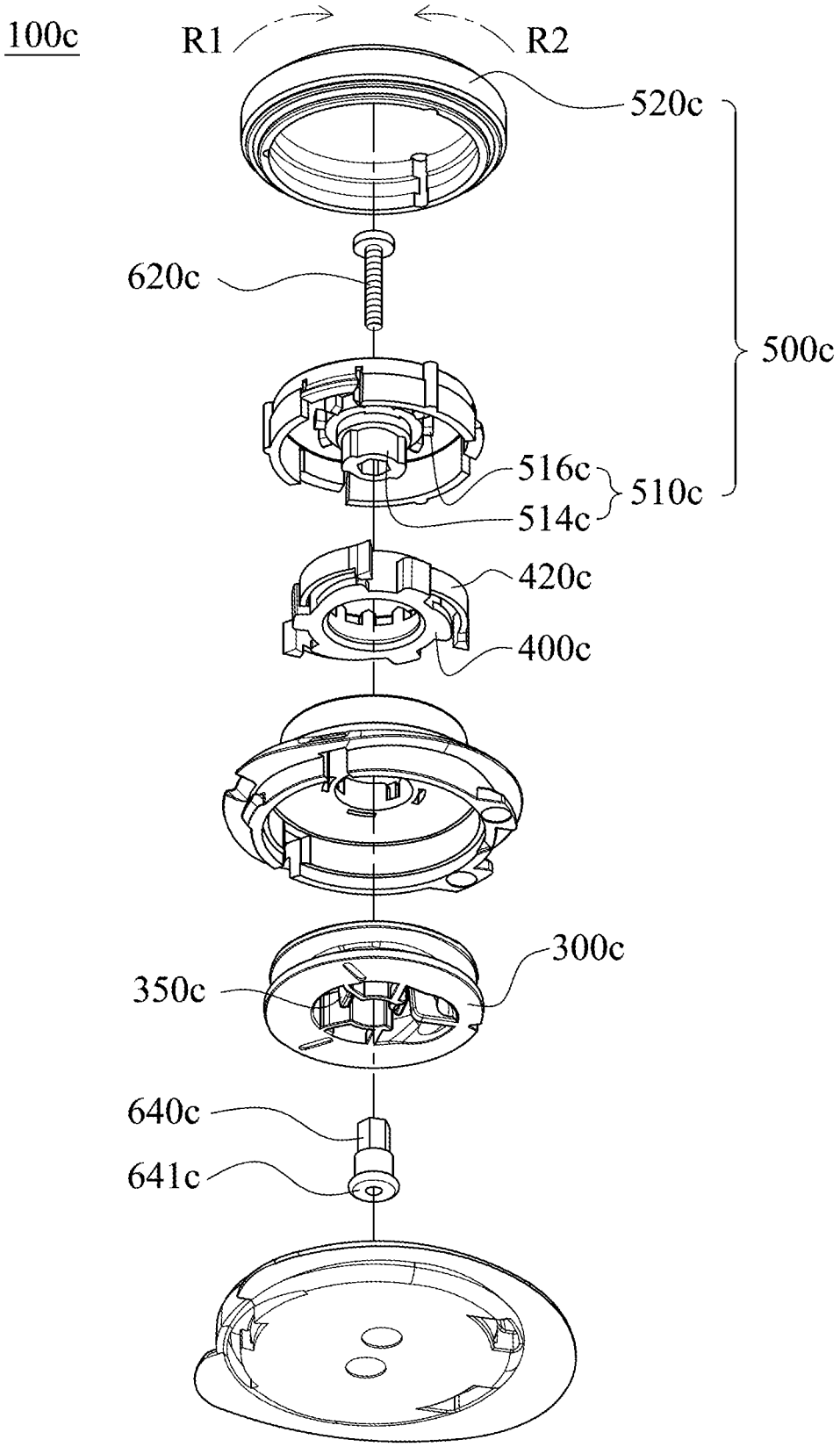
FIG. 15 shows another exploded view of the fastening device of FIG. 13.

FIG. 13 shows a three dimensional schematic view of a fastening device 100*c* according to a fourth embodiment of the present disclosure. FIG. 14 shows one exploded view of the fastening device 100*c* of FIG. 13. FIG. 15 shows another exploded view of the fastening device 100*c* of FIG. 13. The fastening device 100*c* includes a knob 500*c*, and the structure of the knob 500*c* is similar to the knob 500*a* of the second embodiment and includes a shield cover 520*c* made of metal and a main body 510*c* made of a composite material. In addition, the structure of the knob 500*c* and other components of the fastening device 100*c* are slightly different from the fastening device 100 of the first embodiment.

To be more specific, the fastening device 100*c* includes a spool 300*c*, an engaging unit 400*c*, a case unit (not labeled in the fourth embodiment) and a connecting unit 600*c*. The main body 510*c* can include a plurality of knob teeth 516*c*, and the engaging unit 400*c* can include a plurality of engaging teeth 460*c* and three pawl arms 420*c*. The engaging teeth 460*c* correspond to the knob teeth 516*c*, and the pawl arms 420*c* correspond to the mounting teeth 240*c*.

The spool 300*c* includes an upper boss and a driving hole 340*c*. The upper boss is located above the upper ring portion (not labeled in the fourth embodiment), and the driving hole 340*c* penetrating the upper boss and the upper ring portion is configured for the central post 514*c* of the knob 500*c* to insert therein, thereby allowing the knob 500*c* to rotate with the spool 300*c*.

The spool 300*c* can further include a flexible clamping portion 350*c*, and the flexible clamping portion 350*c* includes two clamping arms protruding downward from an intersection of the driving hole 340*c* and the upper ring portion to form a clamping space. The connecting unit 600*c* includes a screw member 620*c* and a positioning shaft 640*c*. The positioning shaft 640*c* inserts the clamping space and the driving hole 340*c*, and the positioning shaft 640*c* includes a positioning protrusion 641*c* coupled to the flexible clamping portion 350*c*. The screw member 620*c* inserts downward from the main body 510*c* and passes through the central post 514*c* to fasten into the positioning shaft 640*c*.

Figure 16:
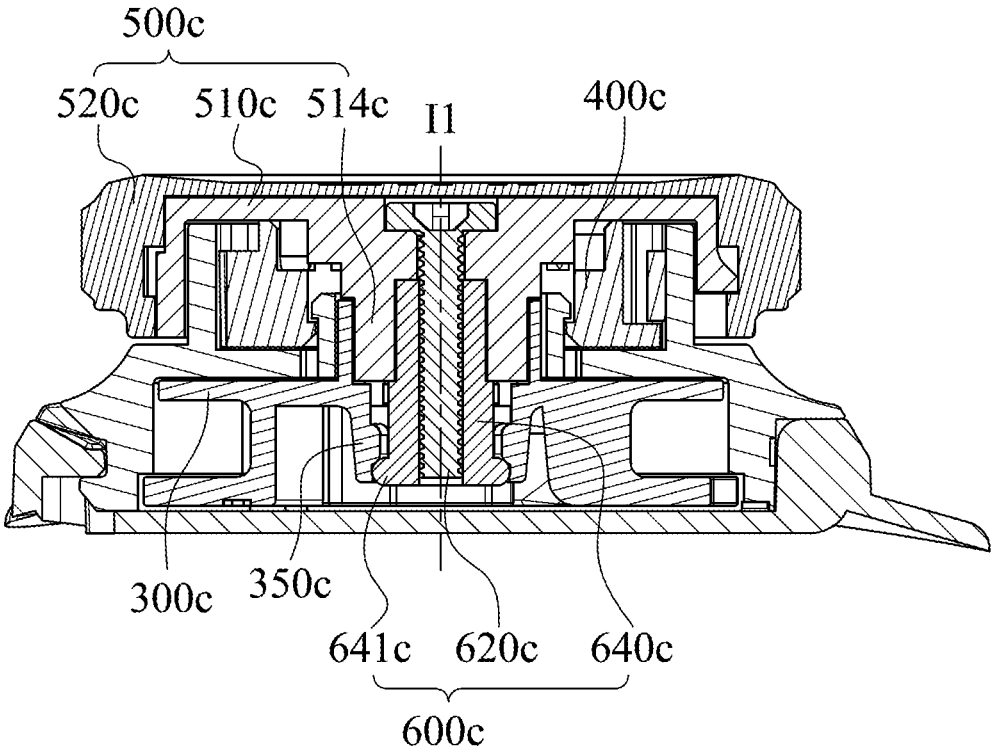
FIG. 16 shows one cross-sectional view of the fastening device of FIG. 13.
Figure 17:
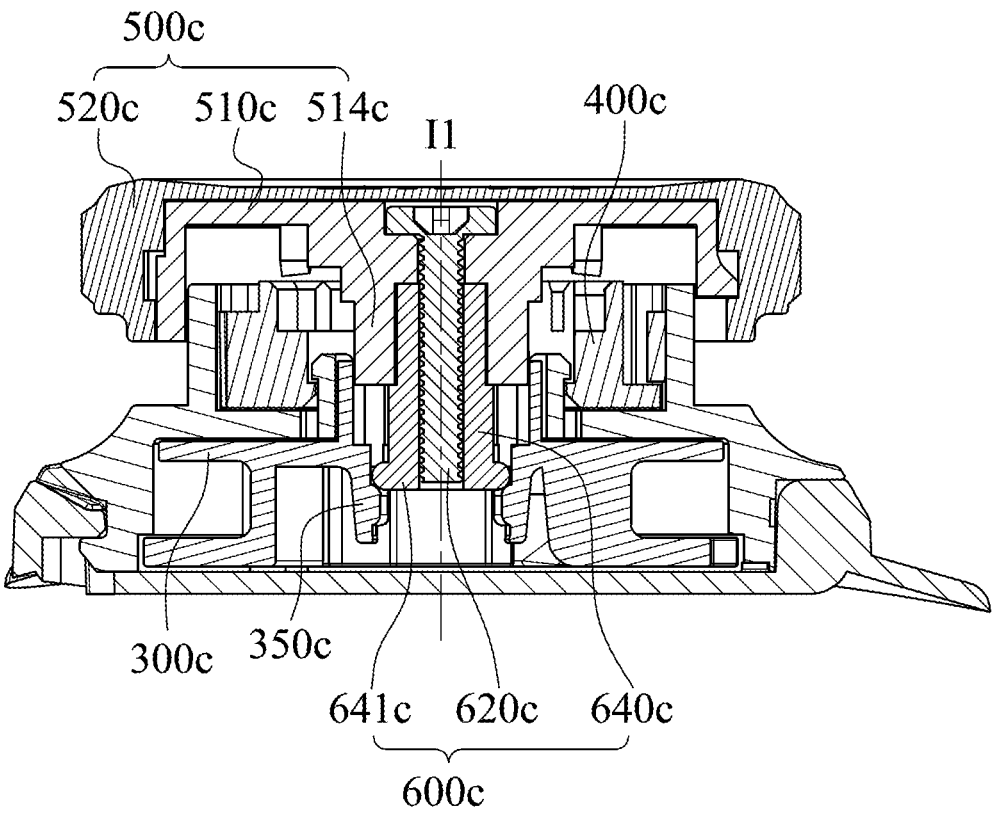
FIG. 17 shows another cross-sectional view of the fastening device of FIG. 13.

FIG. 16 shows one cross-sectional view of the fastening device 100*c* of FIG. 13. FIG. 17 shows another cross-sectional view of the fastening device 100*c* of FIG. 13. Please refer to FIGS. 16 and 17, the knob 500*c* can be pulled up along the axial direction I1 to switch from a fastening position to a releasing position. Precisely, in FIG. 16, the knob 500*c* is not pulled up and is in the fastening position, the pawl arm 420*c* corresponds to the mounting teeth 240*c*, and the engaging teeth 460*c* correspond to the knob teeth 516*c*. As the user holds the shield cover 520*c* to rotate the knob 500*c* in the tightening direction R2, the spool 300*c* can rotate in the tightening direction R2 to tension the lace. As the user stops forcing, the distal end of the pawl arm 420*c* is engaged with the mounting teeth 240*c* to prohibit the spool 300*c* from rotating in the loosening direction R1, and the lace cannot be released.

In contrast, as shown in FIG. 17, the knob 500*c* is pulled up to the releasing position, only the knob 500*c* and the connecting unit 600*c* move along the axial direction I1, and the positioning protrusion 641*c* of the positioning shaft 640*c* is moved from the lower side of the protrusion of the flexible clamping portion 350*c* to the upper side of the protrusion. Although the spool 300*c* is still linked with the knob 500*c*, rotation of the spool 300*c* is not affected owing to the separation of the knob teeth 516*c* and the engaging teeth 460*c*, and the lace can be released.

Figure 18:
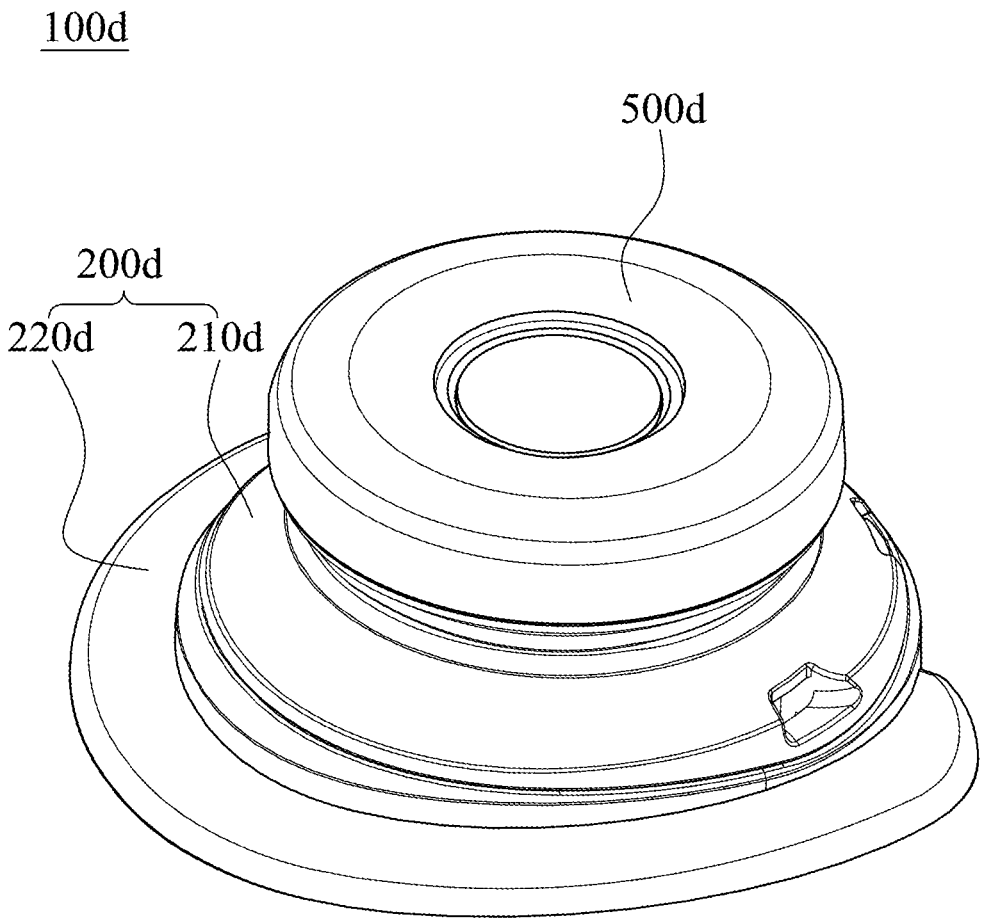
FIG. 18 shows a three dimensional schematic view of a fastening device according to a fifth embodiment of the present disclosure.
Figure 19:
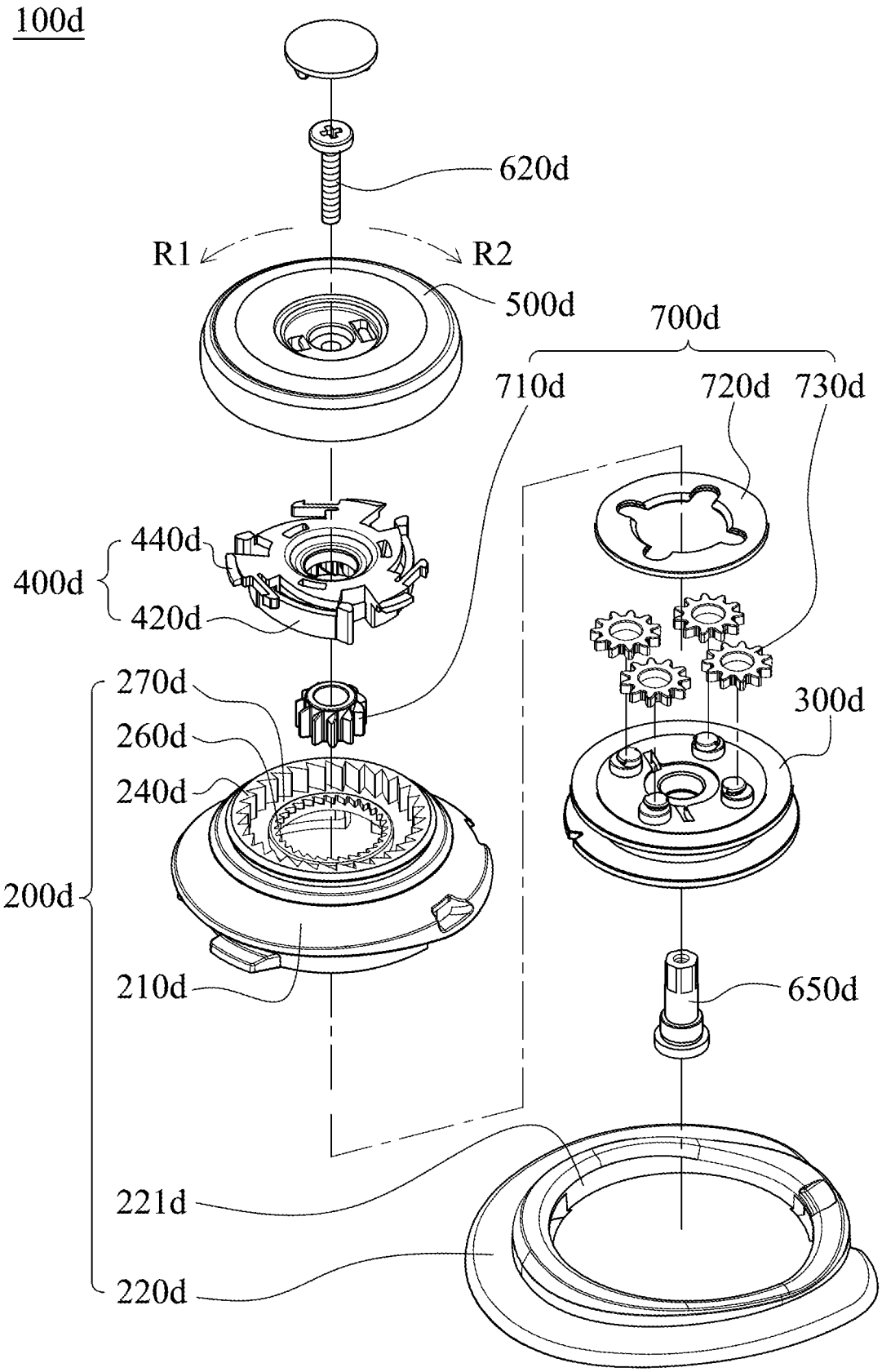
FIG. 19 shows one exploded view of the fastening device of FIG. 18.
Figure 20:
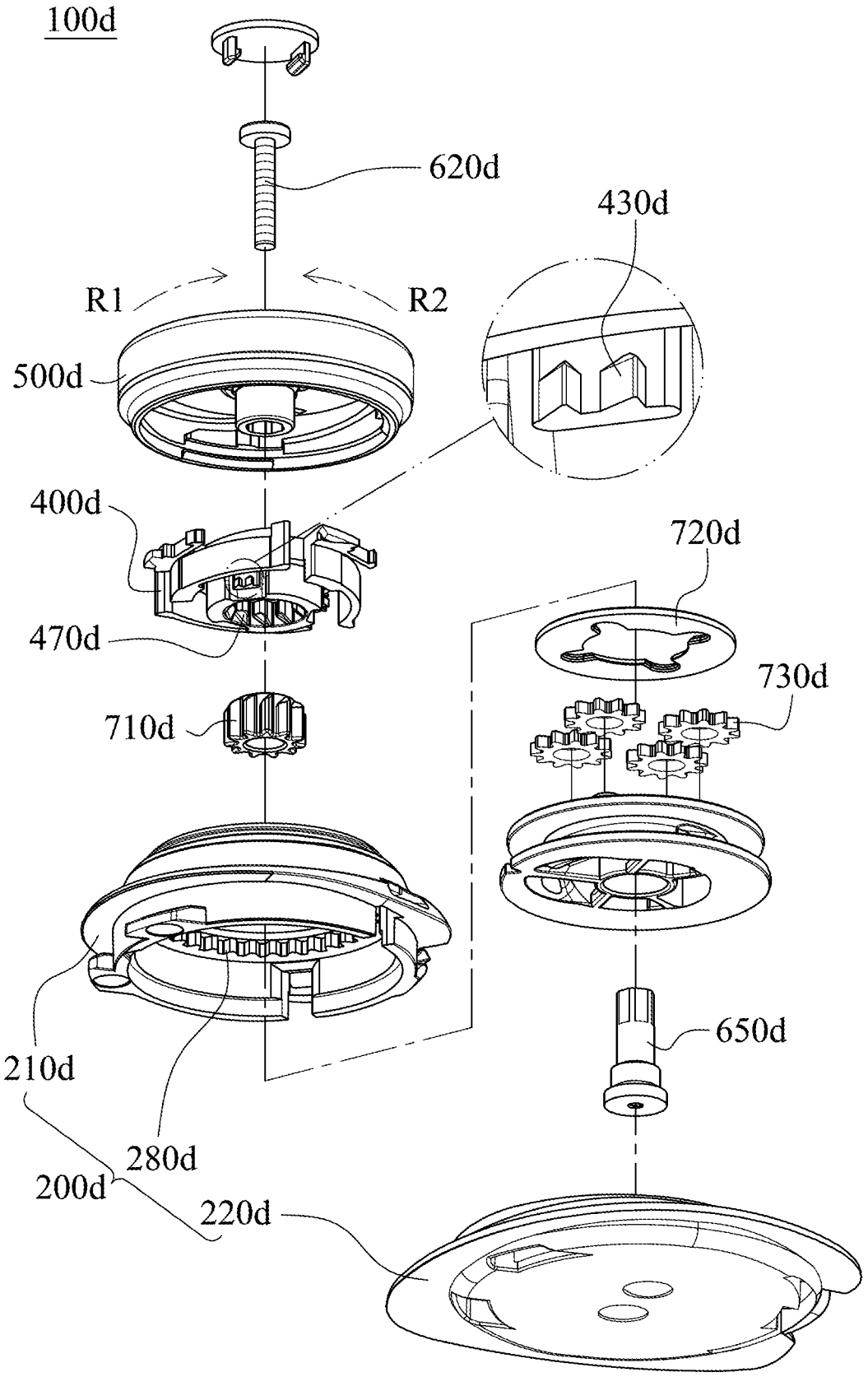
FIG. 20 shows another exploded view of the fastening device of FIG. 18.

FIG. 18 shows a three dimensional schematic view of a fastening device 100*d* according to a fifth embodiment of the present disclosure. FIG. 19 shows one exploded view of the fastening device 100*d* of FIG. 18. FIG. 20 shows another exploded view of the fastening device 100*d* of FIG. 18. The fastening device 100*d* includes a knob 500*d*, an engaging unit 400*d*, a spool 300*d*, a transmission set 700*d*, a case unit 200*d* and a connecting unit (not labeled in the fifth embodiment). The case unit 200*d* includes a base 220*d* and an annular wall 210*d*. The base 220*d* includes an inner engaging surface 221*d* coordinating with the annular wall 210*d*. An inner diameter of the inner engaging surface 221*d* is D1 (shown in FIGS. 21 and 22), an outer diameter of the knob 500*d* is D2 (shown in FIGS. 21 and 22), and D2/D1 is greater than or equal to 0.1 and smaller than or equal to 0.99. In the fifth embodiment, D2/D1 is proximate 0.94. In other words, a small knob 500*d* can be made to coordinate with a large inner engaging surface 221*d*. In one embodiment, if the fastening device is used in the daily life, D2/D1 is ranged from 0.5 to 0.99, and if the fastening device is used in the industry filed or in the situation requiring a long lace, the size of the spool has to be increased for winding the long lace, and D2/D1 is ranged from 0.1 to 0.5.

The case unit 200*d* can further include a plurality of inner teeth 280*d* and a plurality of stopping teeth 260*d*. To be more specific, the case unit 200*d* can include a partition 270*d*, a central hole and a protruding ring. The partition 270*d* protrudes radially and inward from the annular wall 210*d* to separate the receiving space (not labeled in the fifth embodiment) into an upper chamber and a lower chamber. The inner teeth 280*d* are disposed at the annular wall 210*d* and located at the lower chamber, and the spool 300*d* can be received in the lower chamber. The central hole penetrates the partition 270*d* and is communicated with the upper chamber and the lower chamber. The protruding ring protrudes upward from an intersection between the partition 270*d* and the central hole, and the stopping teeth 260*d* are located at the upper end of the inner surface of the protruding ring.

The engaging unit 400*d* includes a ring body (not labeled in the fifth embodiment), three guiding portions 440*d*, three stop portions 430*d* and a plurality of driving teeth 470*d*. The guiding portions 440*d* are coordinated with the spiral track (not labeled in the fifth embodiment) of the knob 500*d*, the structures and relationship thereof are similar with the guiding portions 440 and the spiral track 515 of the first embodiment, and the details will not be repeated. The ring body can include three suspending arms protruding downward, and each of the stop portions 430*d* can be located at each the suspending arms and corresponds to the stopping teeth 260*d*.

The transmission set 700*d* can include a sun gear 710*d*, a plurality of planetary gears 730*d* and a plate 720*d*. The sun gear 710*d* is driven by the driving teeth 470*d* of the engaging unit 400*d*. Each of the planetary gear 730*d* is pivotally disposed on each pivoted shaft of the spool 300*d* and is engaged with the sun gear 710*d* and the inner teeth 280*d* of the case unit 200*d*. The plate 720*d* is positioned on the planetary gears 730*d* and covers the planetary gears 730*d*.

The connecting unit can include a central shaft 650*d* and a screw member 620*d*. The central shaft 650*d* passes through the spool 300*d* and the sun gear 710*d* to enter the central post (not labeled in the fifth embodiment) of the knob 500*d*, and the screw member 620*d* passes through the central post downward to fasten with the central shaft 650*d*.

Figure 21:
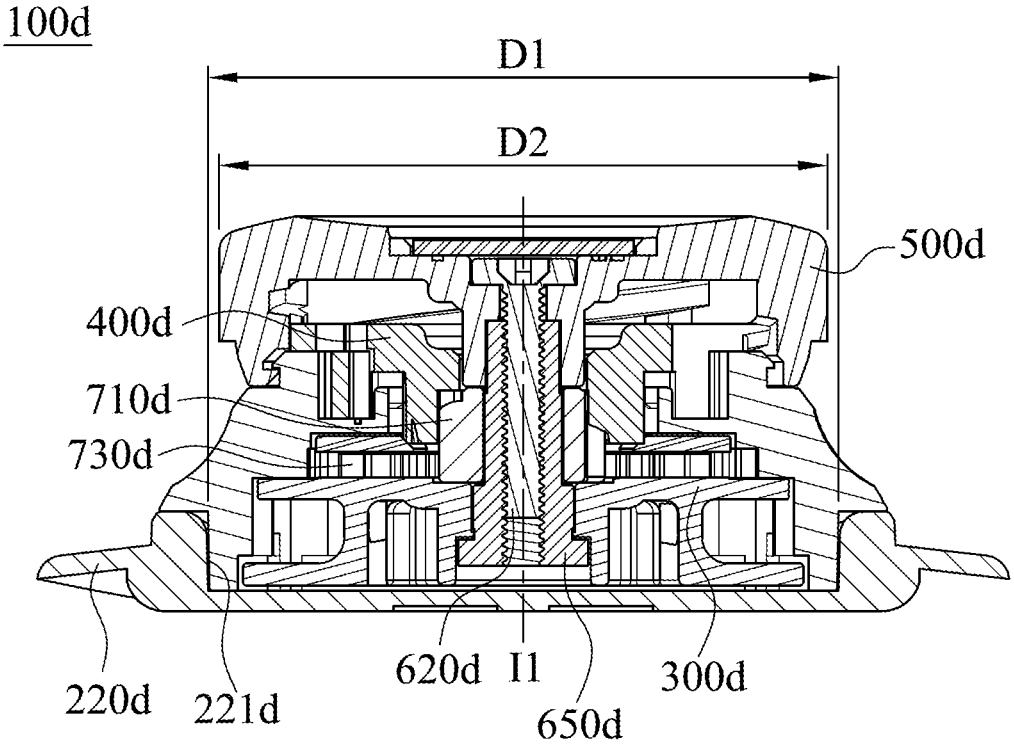
FIG. 21 shows one cross-sectional view of the fastening device of FIG. 18.
Figure 22:
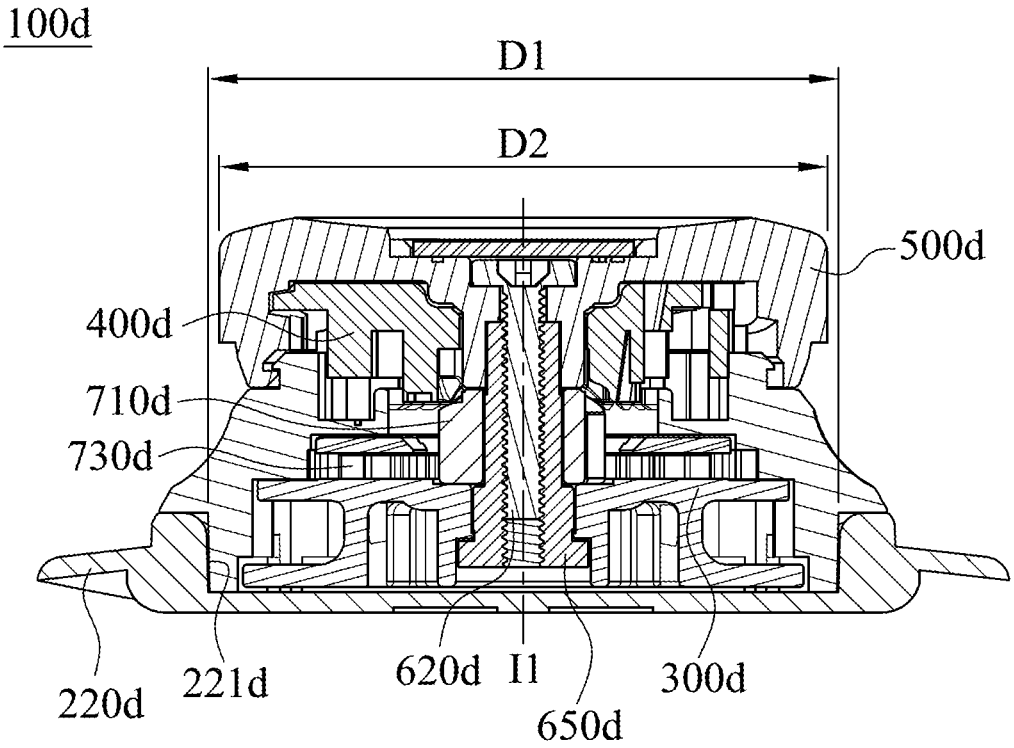
FIG. 22 shows another cross-sectional view of the fastening device of FIG. 18.

FIG. 21 shows one cross-sectional view of the fastening device 100*d* of FIG. 18. FIG. 22 shows another cross-sectional view of the fastening device 100*d* of FIG. 18. Please refer to FIGS. 21 and 22 with references of FIGS. 18 to 20. Rotating the knob 500*d* in a loosening direction R1 can cause the engaging unit 400*d* to switch from a first position to a second position along an axial direction I1. As shown in FIG. 21, the engaging unit 400*d* is in the first position, and the pawl arm 420*d* corresponds to the mounting teeth 240*d*. As the user rotates the knob 500*d* in the tightening direction R2, the sun gear 710*d* can be rotated, and the planetary gear 730*d* rotates relative to the inner teeth 280*d* to allow the spool 300*d* to rotate in the tightening direction R2 for tensioning the lace. As the user stops forcing, the distal end of the pawl arm 420*d* will be engaged with the mounting teeth 240*d* to prohibit the spool 300*d* from rotating in the loosening direction R1, and the lace cannot be released. Please be noted that, the stop portion 430*d* does not correspond to the stopping teeth 260*d*, and therefore rotation of the spool 300*d* in the tightening direction R2 is not affected.

In the contrast, as rotating the knob 500*d* in the loosening direction R1 to switch the engaging unit 400*d* to the second position, the driving teeth 470*d* are disengaged from the sun gear 710*d*, rotation of the spool 300*d* is not affected, and the lace can be released. Meanwhile, the stop portion 430*d* corresponds to the stopping teeth 260*d*, thereby favorable for the engaging unit 400*d* to lower to the first position.

Figure 23:
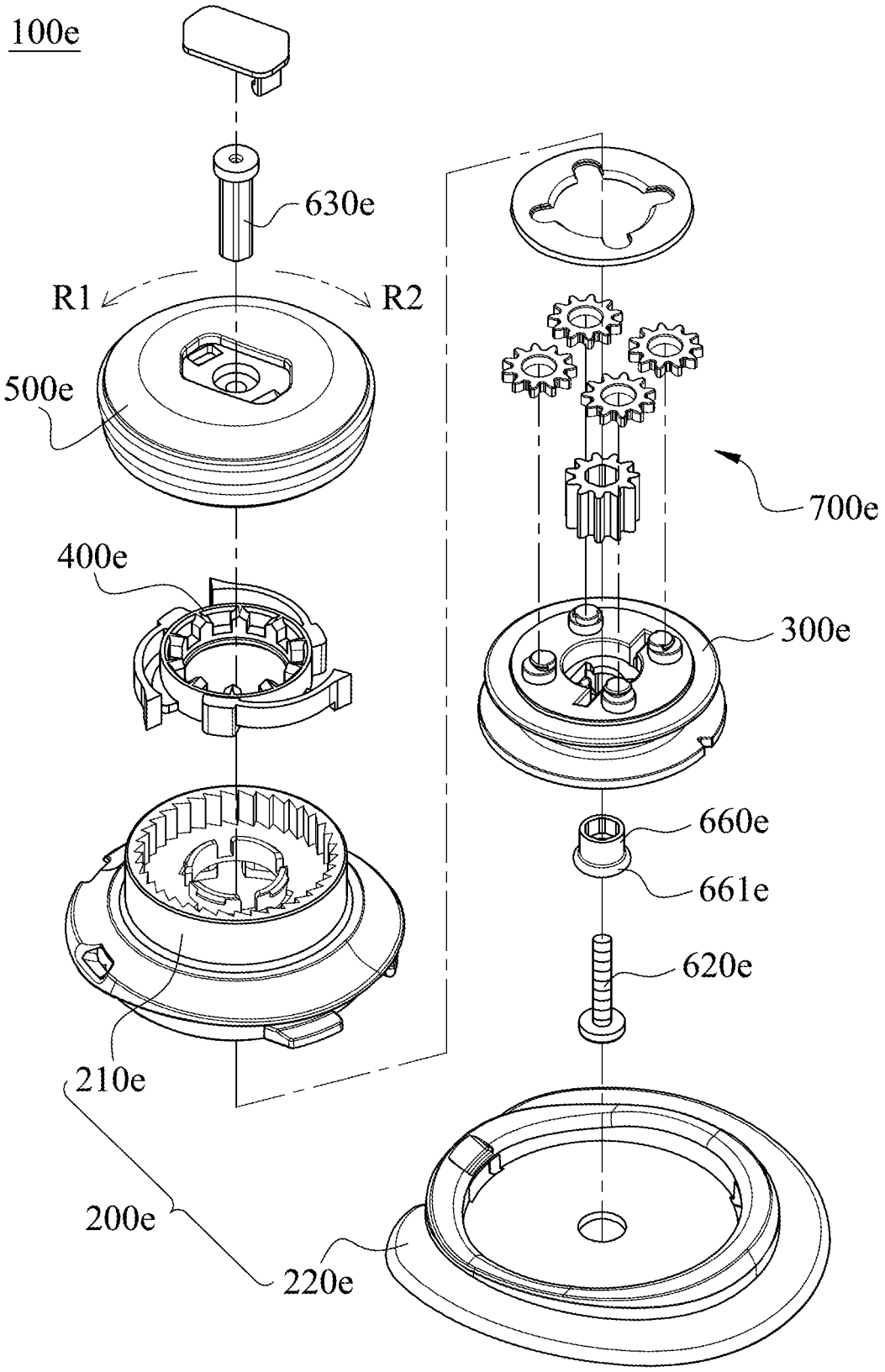
FIG. 23 shows one exploded view of a fastening device according to a sixth embodiment of the present disclosure.
Figure 24:
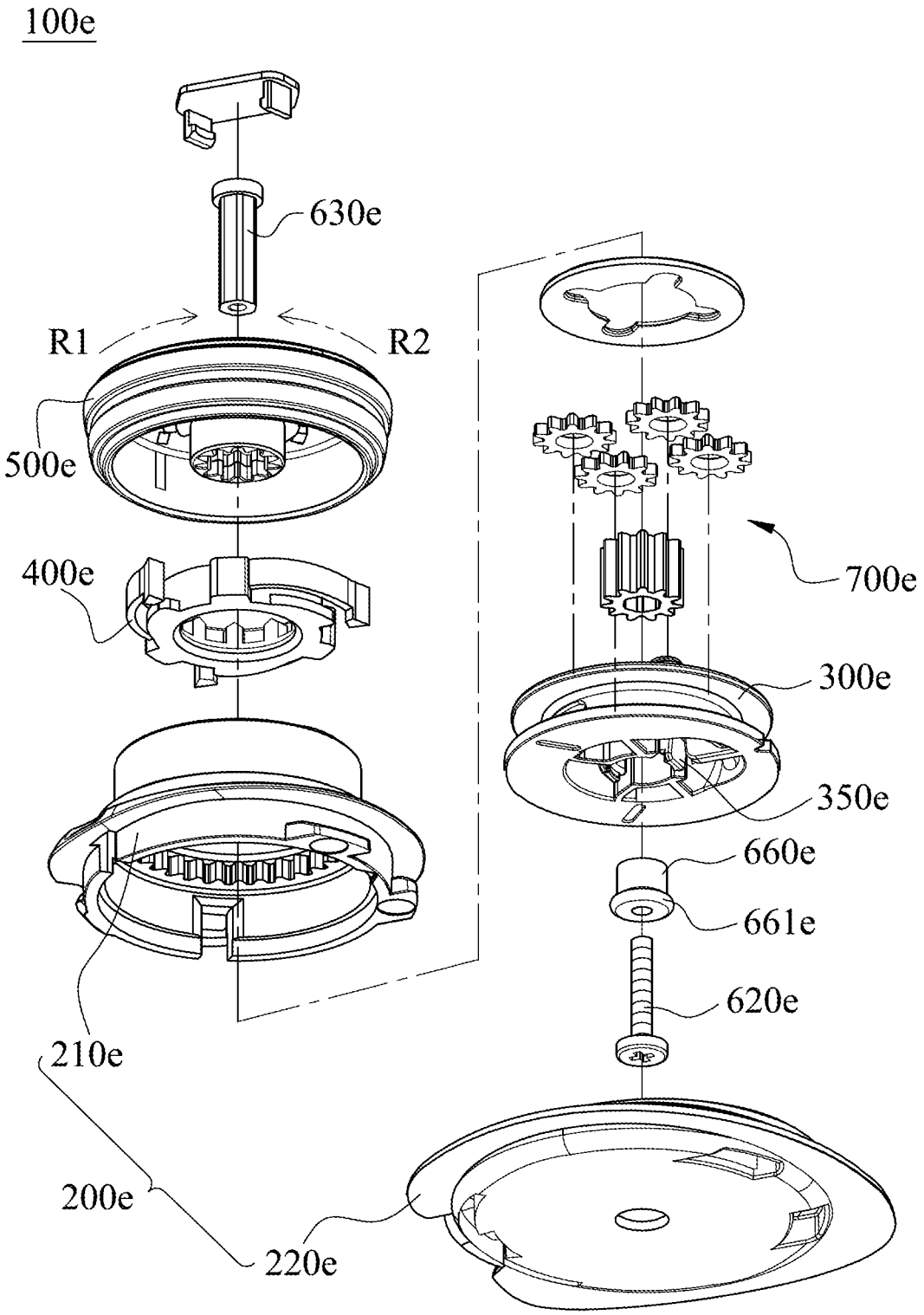
FIG. 24 shows another exploded view of the fastening device of FIG. 23.
Figure 25:
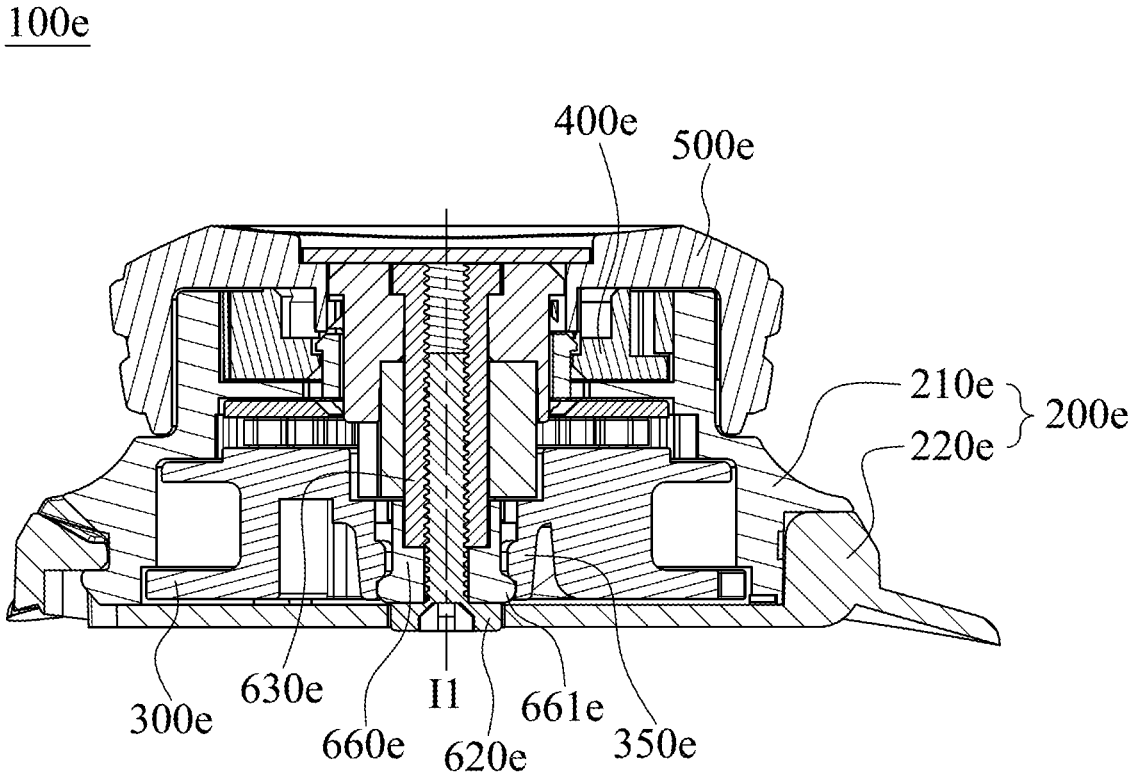
FIG. 25 shows one cross-sectional view of the fastening device of FIG. 23.
Figure 26:
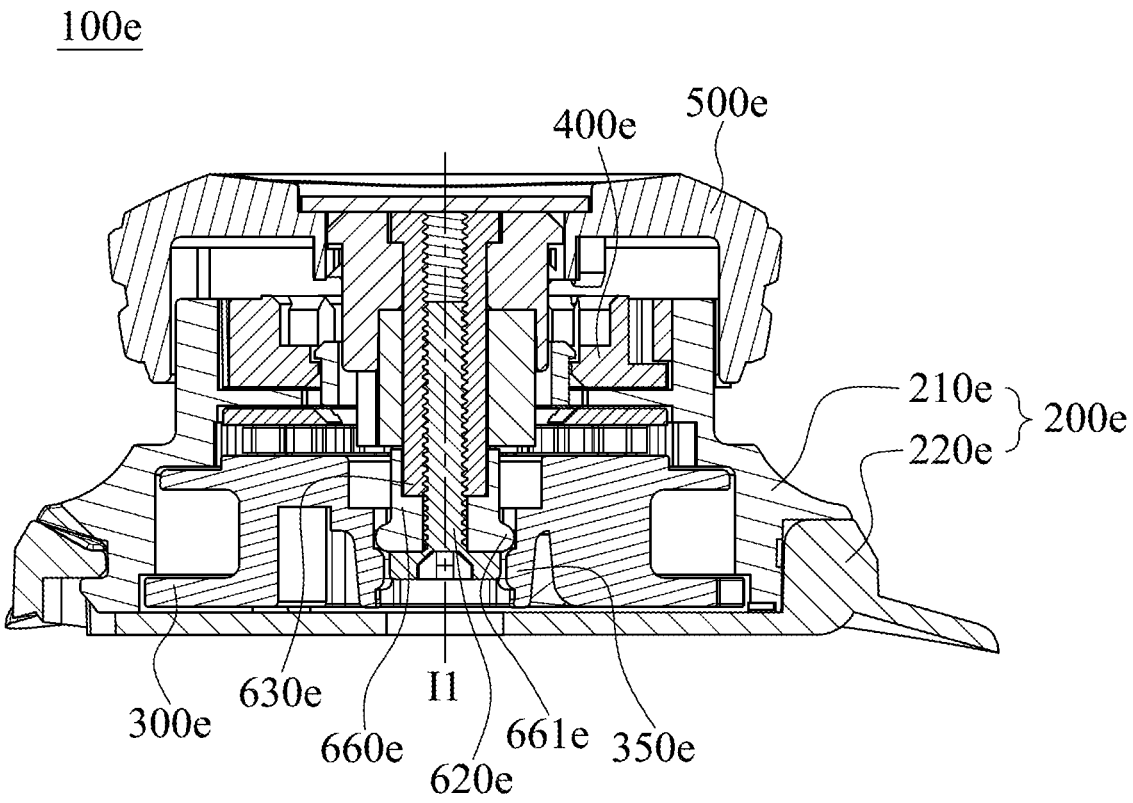
FIG. 26 shows another cross-sectional view of the fastening device of FIG. 23.

FIG. 23 shows one exploded view of a fastening device 100*e* according to a sixth embodiment of the present disclosure. FIG. 24 shows another exploded view of the fastening device 100*e* of FIG. 23. FIG. 25 shows one cross-sectional view of the fastening device 100*e* of FIG. 23. FIG. 26 shows another cross-sectional view of the fastening device 100*e* of FIG. 23. The fastening device 100*e* includes a knob 500*e*, an engaging unit 400*e*, a spool 300*e*, a transmission set 700*e*, a case unit 200*e* and a connecting unit (not labeled in the sixth embodiment). The case unit 200*e* can include a base 220*e* and an annular wall 210*e*, and the structure of the transmission set 700*e* is identical to the structure of the transmission set 700*d* in the fifth embodiment.

The knob 500*e* can be pulled upward or pressed downward along the axial direction I1 to be positioned in the fastening position of FIG. 25 or in the releasing position of FIG. 26. Hence, the spool 300*e* can include a flexible clamping portion 350*e*, and the connecting unit can include a screw member 620*e*, a screw sleeve 630*e* and a positioning sleeve 660*e*. During assembly, the positioning sleeve 660*e* is put into the central clearance hole of the spool 300*e* to allow the positioning protrusion 661*e* to couple to the flexible clamping portion 350*e*, and the screw member 620*e* inserts upward into the hole of the positioning sleeve 660*e* to fasten with the screw sleeve 630*e* located in the central post (not labeled in the sixth embodiment) of the knob 500*e*.

Figure 27:
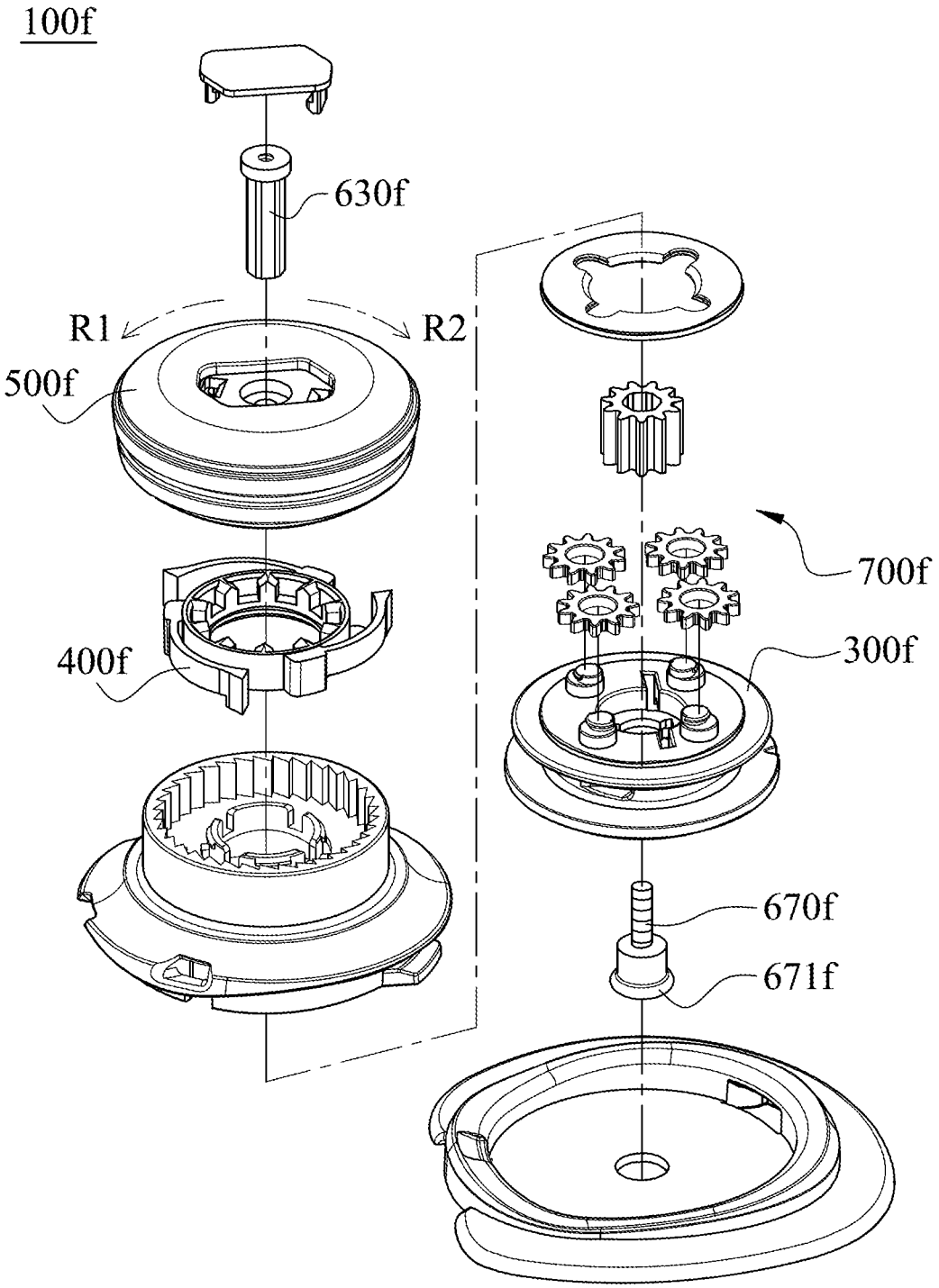
FIG. 27 shows one exploded view of a fastening device according to a seventh embodiment of the present disclosure.
Figure 28:
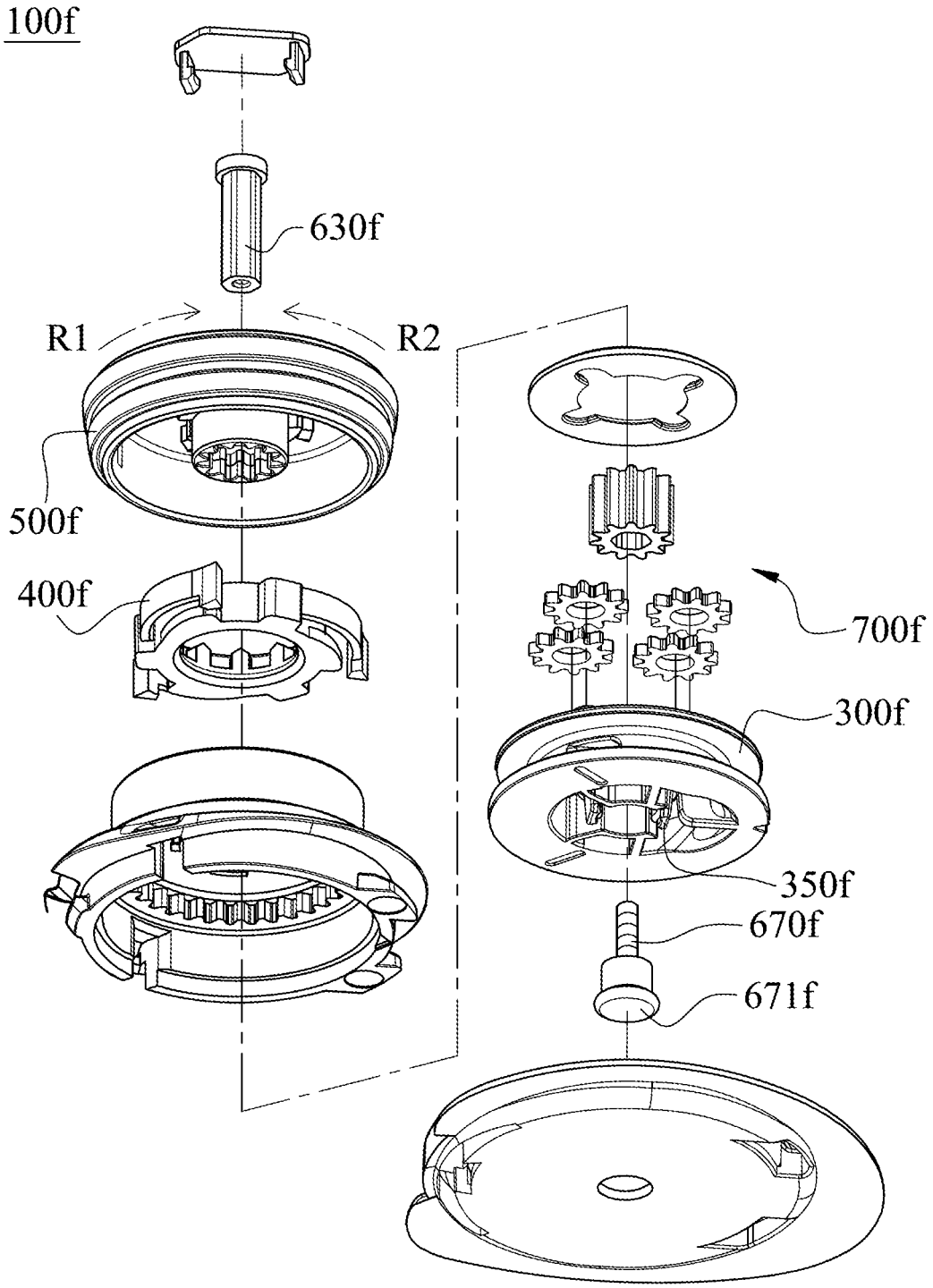
FIG. 28 shows another exploded view of the fastening device of FIG. 27.
Figure 29:
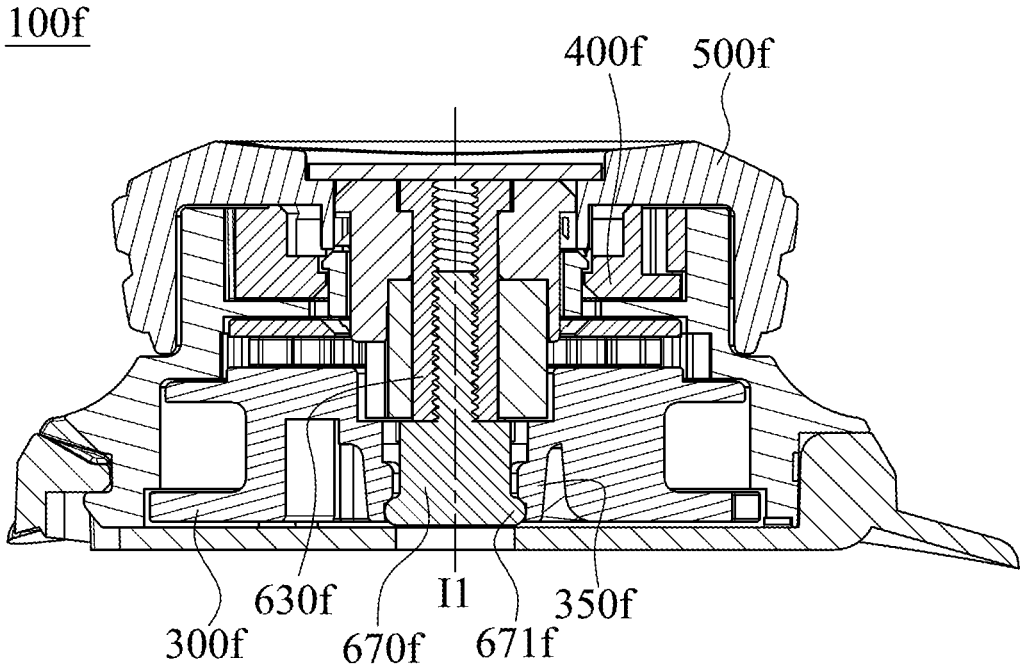
FIG. 29 shows one cross-sectional view of the fastening device of FIG. 27.
Figure 30:
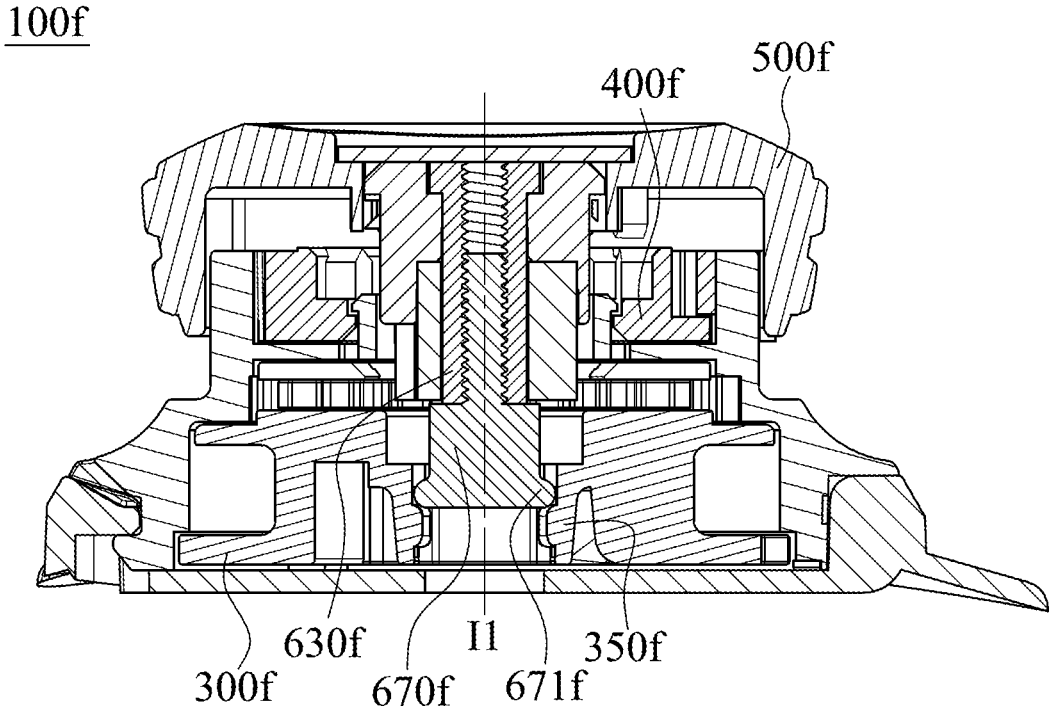
FIG. 30 shows another cross-sectional view of the fastening device of FIG. 27.

FIG. 27 shows one exploded view of a fastening device 100*f* according to a seventh embodiment of the present disclosure. FIG. 28 shows another exploded view of the fastening device 100*f* of FIG. 27. FIG. 29 shows one cross-sectional view of the fastening device 100*f* of FIG. 27. FIG. 30 shows another cross-sectional view of the fastening device 100*f* of FIG. 27. The fastening device 100*f* includes a knob 500*f*, an engaging unit 400*f*, a spool 300*f*, a transmission set 700*f*, a case unit (not labeled in the seventh embodiment) and a connecting unit (not labeled in the seventh embodiment). The fastening device 100*f* is similar to the fastening device 100*e* of the sixth embodiment, and the knob 500*f* can be pulled upward or pressed downward along the axial direction I1 to be positioned in the fastening position of FIG. 29 or in the releasing position of FIG. 30. The difference is that the connecting unit includes a screw sleeve 630*f* and a positioning screw 670*f*. The positioning screw 670*f* includes a positioning protrusion 671*f* coupled to the flexible clamping portion 350*f* of the spool 300*f*, and other similar or identical structures will not be repeated.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A fastening device, comprising:

a case unit comprising a receiving space;

a spool located within the receiving space and configured for a lace to be wound therearound; and a knob covering on the case unit and comprising:

a main body made of a composite material; and a shield cover covering on the main body and made of a metal material;

wherein a rotation of the knob drives the spool to rotate in a tightening direction for tensioning the lace.

2. The fastening device of claim 1, wherein the main body further comprises at least one radial engaging portion, the shield cover comprises at least one radial coupling portion and an outer annular portion, and the at least one radial coupling portion is located at the outer annular portion and is coupled to the at least one radial engaging portion.

3. The fastening device of claim 1, wherein the main body further comprises at least one axial rib, the shield cover comprises at least one axial slot and an outer annular portion, and the at least one axial slot is located at the outer annular portion and is coupled to the at least one axial rib.

4. The fastening device of claim 1, wherein the case unit further comprises a snapping portion, the main body further comprises a coupling portion, and the snapping portion is coupled to the coupling portion to connect the main body to the case unit.

5. The fastening device of claim 1, wherein the shield cover comprises an outer annular portion and a metal top portion, the metal top portion is located above the main body, and the outer annular portion extends integrally from the metal top portion.

6. The fastening device of claim 5, further comprising a connecting unit connected to the main body of the knob and being restricted by the spool.

7. The fastening device of claim 1, wherein the case unit further comprises a plurality of mounting teeth and an annular wall, each of the mounting teeth is located at the annular wall and comprises a tip portion, the spool comprises an upper ring portion, and a distance between the tip portions of two of the mounting teeth opposite thereto is smaller than a diameter of the upper ring portion.

8. The fastening device of claim 1, wherein the case unit further comprises an annular wall, the annular wall comprises a lower ring groove, the spool comprises a lower ring portion, and the lower ring portion is received in the lower ring groove, thereby preventing the spool from leaving the receiving space from an upper opening of the annular wall.

9. The fastening device of claim 1, further comprising an engaging unit, wherein the rotation of the knob in a loosening direction allows the engaging unit to switch from a first position to a second position along an axial direction.

* * * * *